US008337751B2

(12) United States Patent
Stewart et al.

(10) Patent No.: US 8,337,751 B2
(45) **Date of Patent: *Dec. 25, 2012**

(54) DECONTAMINATION AND CONTAMINANT PROCESSING SYSTEM AND METHOD

(76) Inventors: Ricky William Stewart, Mukilteo, WA (US); Lee Walker Brillhart, III, Seattle, WA (US)

( * ) Notice: Subject to any disclaimer, the term of this patent is extended or adjusted under 35 U.S.C. 154(b) by 282 days.

This patent is subject to a terminal disclaimer.

(21) Appl. No.: 12/799,460

(22) Filed: Apr. 26, 2010

(65) Prior Publication Data

US 2010/0212085 A1 Aug. 26, 2010

Related U.S. Application Data

(60) Division of application No. 11/899,371, filed on Sep. 4, 2007, now Pat. No. 7,703,467, which is a continuation of application No. 10/851,680, filed on May 20, 2004, now Pat. No. 7,299,811, which is a continuation of application No. 10/123,086, filed on Apr. 12, 2002, now Pat. No. 6,742,309.

(51) Int. Cl.

| | |
|---|---|
| ***A61L 9/00*** | (2006.01) |
| ***E04H 15/16*** | (2006.01) |
| ***E04H 15/02*** | (2006.01) |
| ***E04H 15/18*** | (2006.01) |
| ***A47K 3/22*** | (2006.01) |
| ***B01L 1/04*** | (2006.01) |

(52) U.S. Cl. ..... 422/1; 422/305; 52/79.5; 135/94; 135/96; 135/97; 4/597; 4/598; 4/599; 4/602; 454/187; 454/228; 454/902

(58) Field of Classification Search ..... 422/1, 305; 52/79.5; 135/94, 96–97; 4/597–599, 602; 454/187, 228, 902

See application file for complete search history.

(56) References Cited

U.S. PATENT DOCUMENTS

| | | | | |
|---|---|---|---|---|
| 5,551,102 | A * | 9/1996 | Stewart et al. | 4/612 |
| 5,916,096 | A * | 6/1999 | Wiesmann et al. | 52/63 |
| 6,742,309 | B2 * | 6/2004 | Stewart et al. | 52/79.5 |

* cited by examiner

*Primary Examiner* — Jill Warden
*Assistant Examiner* — Monzer Chorbaji
(74) *Attorney, Agent, or Firm* — Charles J. Rupnick Attorney at Law

(57) ABSTRACT

A systematic decontamination and containment method for decontaminating personnel is disclosed. This method includes providing a plurality of components positionable on a selected location for establishment of a multi-station decontamination and containment facility to decontaminate personnel and to contain contaminants collected during the decontamination process. The components can include a plurality of collapsible frame and roof assemblies, wall and roof covers, a weapons clearing assembly, a weapons storage locker, a hanging bar, a signage assembly, collapsible containment hamper assemblies, a covered dispensing assembly, a shuffle box, a multi-wipe dispensing assembly, and a transportable containment enclosure. The enclosure is shaped and sized to removably retain the system's components for transportation or the like.

31 Claims, 35 Drawing Sheets

DECONTAMINATION AND CONTAMINANT PROCESSING SYSTEM AND METHOD

This application is a Divisional and claims priority benefit of now allowed parent application Ser. No. 11/899,371, now U.S. Pat. No. 7,703,467 filed in the names of Ricky William Stewart and Lee Walker Brillhart, III on Sep. 4, 2007, which is a Continuation and claims priority benefit of parent U.S. patent application Ser. No. 10/851,680, now U.S. Pat. No. 7,299,811, filed May 20, 2004, which is a Continuation and claims priority benefit of U.S. patent application Ser. No. 10/123,086, filed Apr. 12, 2002, now U.S. Pat. No. 6,742,309, the complete disclosures of which are both incorporated herein by reference.

FIELD OF THE INVENTION

The present invention is directed to a decontamination system and method, and more particularly to a system and method for decontamination and contaminant processing of personnel.

BACKGROUND OF THE INVENTION

Military, law enforcement, fire department, and other public safety personnel often encounter situations in the line of duty involving chemical, biological, or other potentially harmful contaminants. As an example, military personnel may be exposed to chemical or germ warfare. Public safety personnel may be exposed to toxic areas, toxic waste cleanup, or other toxic environments. The personnel can be exposed to potentially harmful chemicals, biological agents, and other contaminants, such that the person's body, clothing, and equipment may be contaminated.

Often when a situation occurs in which personnel are contaminated, the personnel need to be decontaminated as soon as possible to best protect their safety. The decontamination process should be conducted in the best manner possible without further contamination of other personnel and equipment. It is highly desirable to set up a portable decontamination area close to the site where the personnel were contaminated, so the contaminated personnel do not need to be transported to a remote decontamination facility. One difficulty experienced in the prior art is being able to quickly and easily transport sufficient decontamination equipment to a selected location to create the temporary decontamination area. A further difficulty experienced is the ability to quickly construct the temporary facilities with the necessary equipment so that the personnel can be decontaminated as quickly as possible. Temporary facilities and related necessary equipment have been very difficult to transport in an orderly manner. The temporary facilities and equipment also typically require very labor-intensive assembly, including extensive man hours and tools to assemble the components of the facilities or equipment.

Decontamination of the personnel should be conducted as quickly and thoroughly as possible for the personnel's safety. The conventional decontamination facilities and processes can be extremely cumbersome and difficult to manage, particularly when a large number of contaminated personnel and equipment must be processed. A further difficulty experienced in conventional systems and processes for decontamination of multiple personnel is that the contaminates on the personnel and equipment can become airborne and further contaminate the personnel within the decontamination area, including those personnel that have already been substantially decontaminated. Accordingly, it is highly desirable to allow personnel and equipment to be decontaminated while containing the contaminants so others are not contaminated or re-contaminated during the process.

SUMMARY OF THE INVENTION

Embodiments of the present invention provide a decontamination and processing system and methods that overcome drawbacks experienced by the prior art.

DETAILED DESCRIPTION OF PREFERRED EMBODIMENT

Figure 1:
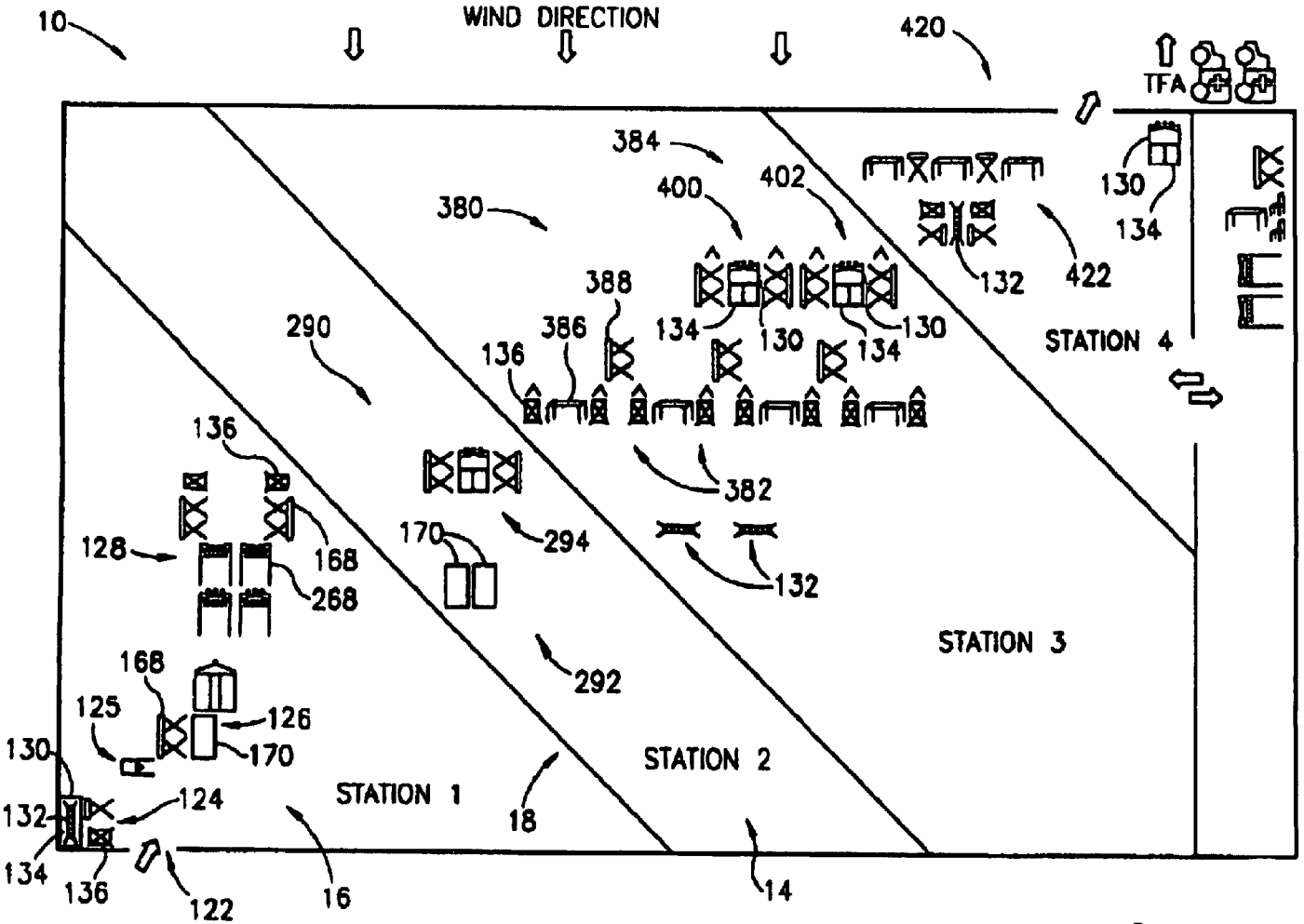
FIG. 1 is a schematic top plan view of a decontamination and containment processing system in a deployed condition over a selected decontamination area in accordance with one embodiment of the present invention.

In the following description, certain specific details are set forth in order to provide a thorough understanding of various embodiments of the invention. However, one skilled in the art will understand that the invention may be practiced without these details. In other instances, well-known structures usable with the decontamination and containment process system or methods have not been shown or described in detail to avoid unnecessarily obscuring the description of the embodiments of the present invention. FIG. 1 is a schematic top plan view illustrating a decontamination and containment processing system 10 in accordance with one embodiment of the present invention. This system 10 is shown deployed on a selected decontamination area 12, such as a field, parking lot, or the like. In one embodiment, the system 10 is deployed on a football field.

Figure 2:
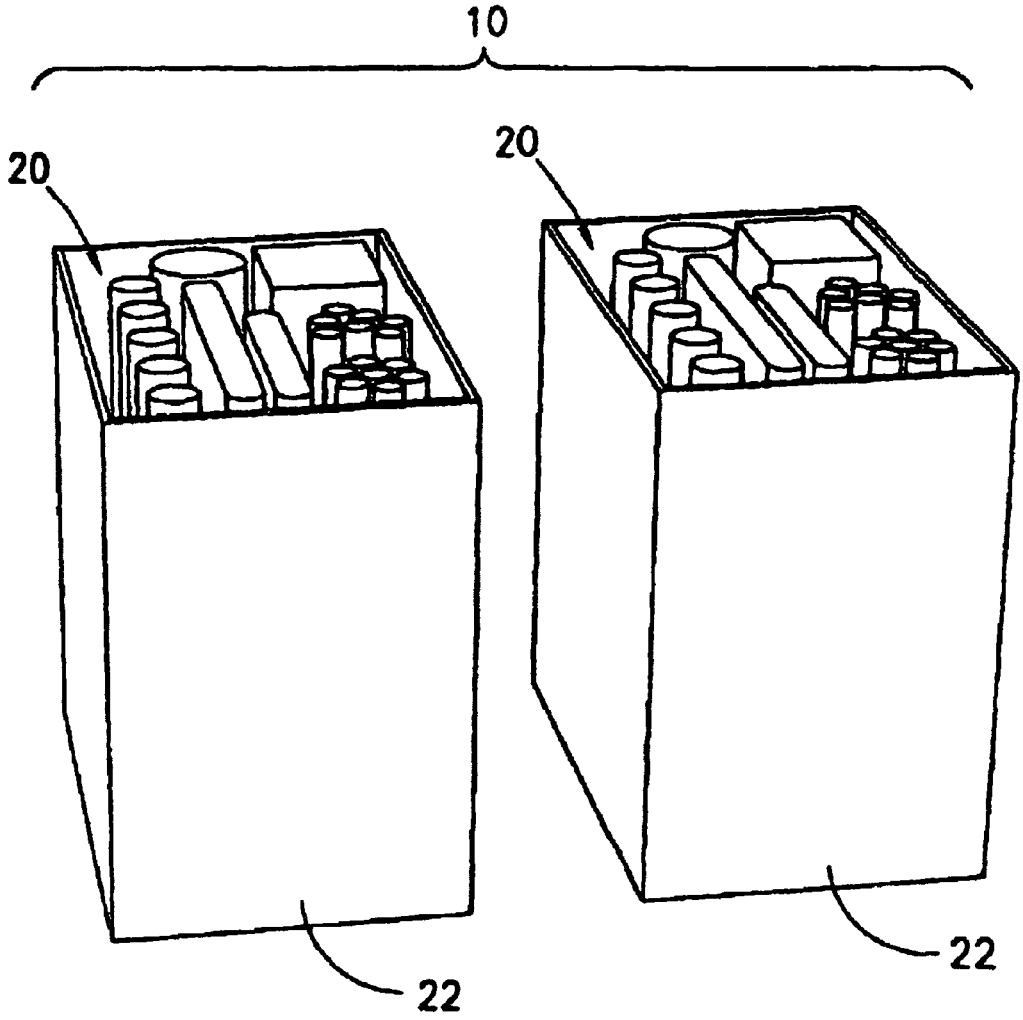
FIG. 2 is an isometric view of the decontamination and containment processing system of FIG. 1 shown in a collapsed position and contained within transportation containers.

The decontamination and containment processing system 10 contains a plurality of collapsible components that can be easily packed for transportation to a selected decontamination area 12 where the system is deployed. As best seen in FIG. 2, the decontamination and containment processing system 10 of the illustrated embodiment includes a plurality of collapsible and packable components 20, including shelter assemblies, weapon clearing and storing assemblies, signage assemblies, rack assemblies, hanger assemblies, hamper assemblies, washtub assemblies, a shower and water delivery systems, and other components discussed in greater detail below. The components 20 of the system 10 can be selected and combined in many configurations to allow a decontamination process to be developed and quickly implemented for any number of contamination scenarios. The selected components 20 can be packed into one or two transport containers 22 to be transported and deployed at the selected decontamination area 12. The containers 22 of the illustrated embodiment are 4 ft.times.4 ft.times.8 ft containers. Accordingly, the decontamination and containment processing system 10 provides a fully operational transportable contamination control area that can be deployed easily and quickly for the effective and efficient decontamination of personnel and equipment.

The decontamination and containment system 10 is designed so it can be deployed and set up by hand without requiring any tools, thereby allowing for quick and easy deployment. When the system 10 is deployed, as shown in one configuration in FIG. 1, a series of sequential stations 14 are provided that allows for multiple contaminated personnel to be systematically decontaminated as they move through the multiple stations. The multiple stations 14 are arranged sequentially on the decontamination area 12 in a diagonal pattern. Each station is substantially facing into the wind so that any contaminants that may become airborne at a station do not blow back into a previous station and re-contaminate personnel or equipment at that previous station.

The deployed system 10 is capable of receiving multiple contaminated personnel, such as military personnel, public safety personnel, or the like, who have been contaminated with chemical or biologically active contaminants. The personnel are received at a first receiving station 16, evaluated, and started through the decontamination process. The contaminated personnel are then move from the first, receiving station 16 and processed sequentially through a plurality of follow-on stations 18, as discussed in greater detail below, to effectively remove all contaminated equipment and clothing, and to de-contaminate the personnel after being processed through the last station.

Figure 3:
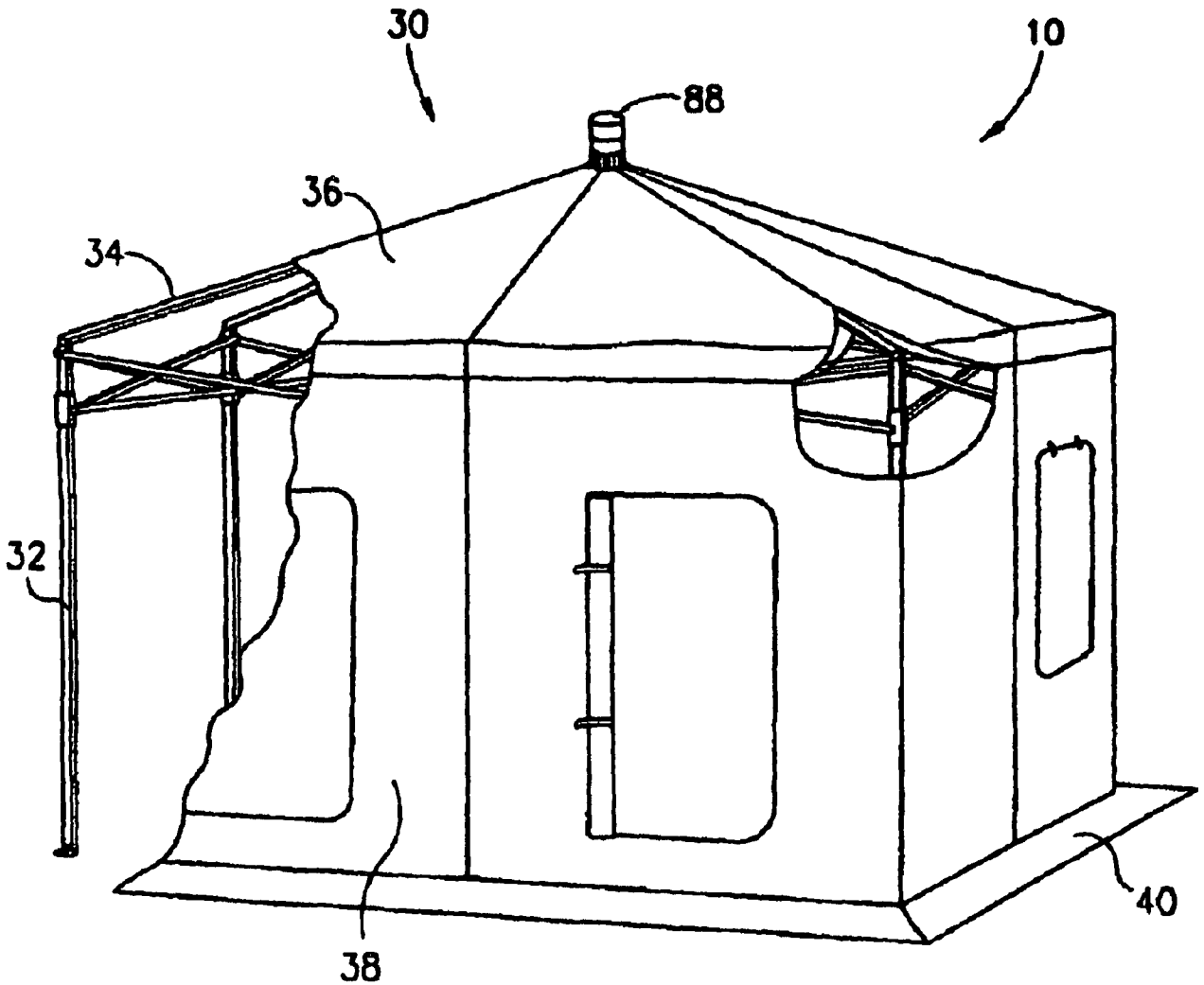
FIG. 3 is an enlarged isometric, partial cutaway view of a shelter assembly of the decontamination and containment processing system of FIG. 1, an outer covering being shown cutaway to show a collapsible shelter frame.

FIG. 3 is an isometric, partially cutaway view of a shelter assembly 30 of the decontamination and containment processing system 10. The shelter assembly 30 includes a collapsible shelter frame 32 that supports a collapsible roof frame 34. A flexible, waterproof roof cover 36 extends over the roof frame 34 and releasably attaches to the roof frame and to the shelter frame 32. The roof cover 36 is securely retained on the roof frame 34 so it can withstand extreme conditions such as wind, rain, snow, dust, and the like. Flexible, full-length wall panels 38 are releasably attached to the shelter frame 32 and also to the roof cover 36 to provide fully enclosed shelter. The wall panels 38 are securely retained on the shelter frame 32 so they can also withstand wind, rain, snow, dust, or other extreme conditions that may be encountered.

In the illustrated embodiment, the wall panels 38 are elongated panels that include water-runoff flaps 40 along the lower perimeter of the shelter assembly 30. The water-runoff flaps 40 extend outwardly over a portion of the ground next to the wall panels so water running down the sidewalls is directed away from the shelter structure. The water-runoff flaps 40 also provide an area of the wall panels 38 on which sand bags or other weighted securing devices can be placed to hold the wall panels down if the shelter frame cannot be adequately staked to the ground. The roof cover 36 and wall panels 38 of the illustrated embodiment are made of durable, waterproof, cloth-like material that can be easily and quickly removed from the shelter and roof frames 32 and 34, and folded into a stored condition. While the shelter assembly 30 illustrated in FIG. 3 has the wall panels 38 and roof cover 36 installed, the shelter assembly in an alternate embodiment can have just the wall panels or just the shelter desired.

Figure 4:
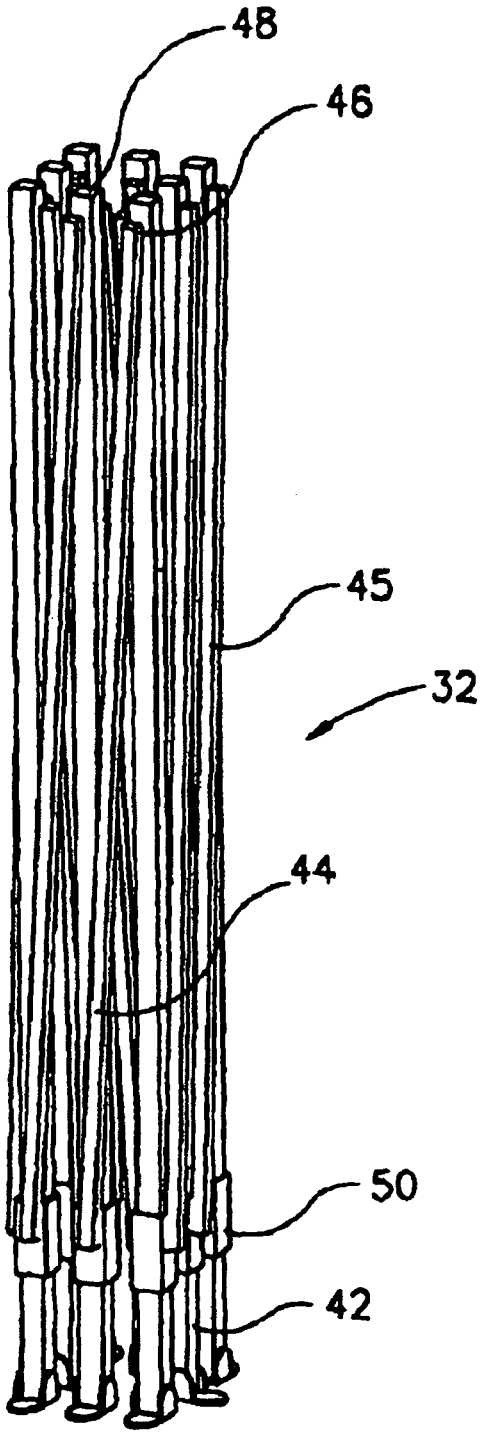
FIG. 4 is an enlarged front elevation view of the collapsible shelter frame of FIG. 3 shown in a collapsed position.
Figure 5:
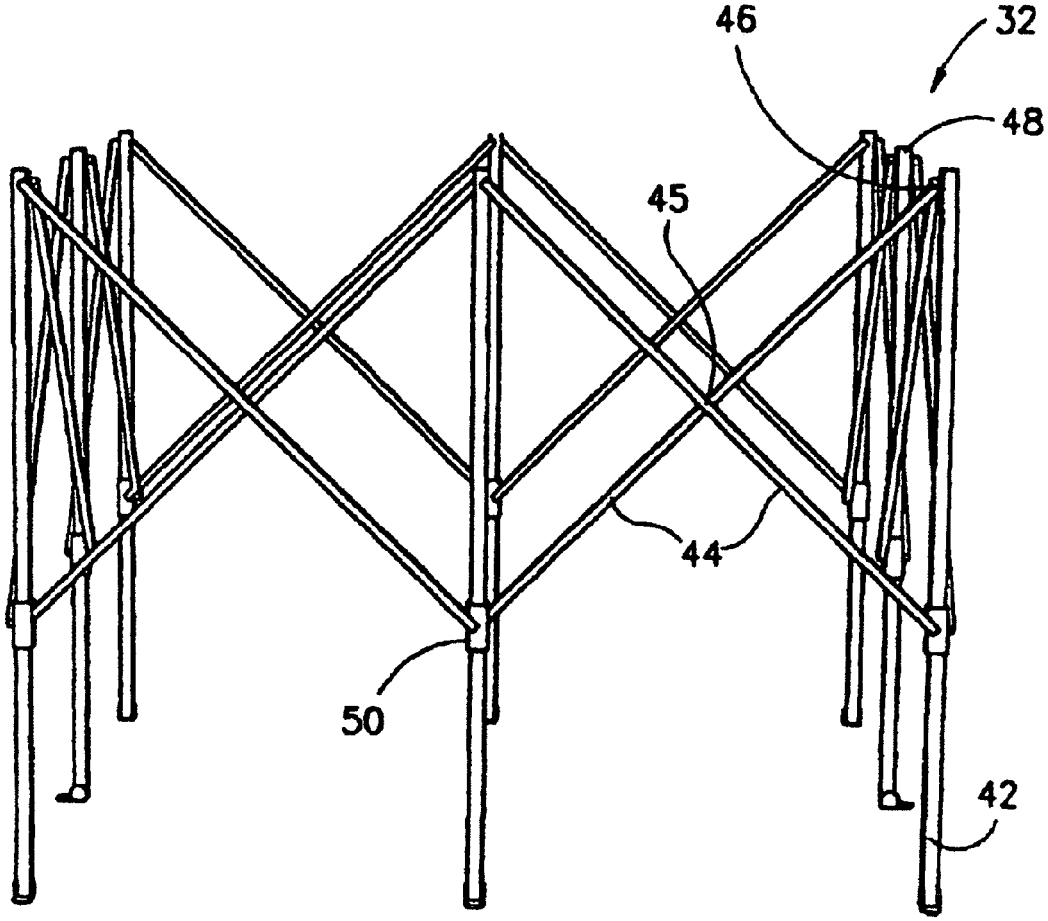
FIG. 5 is an enlarged front elevation view of the shelter frame of FIG. 4 shown in a partially expanded position.
Figure 6:
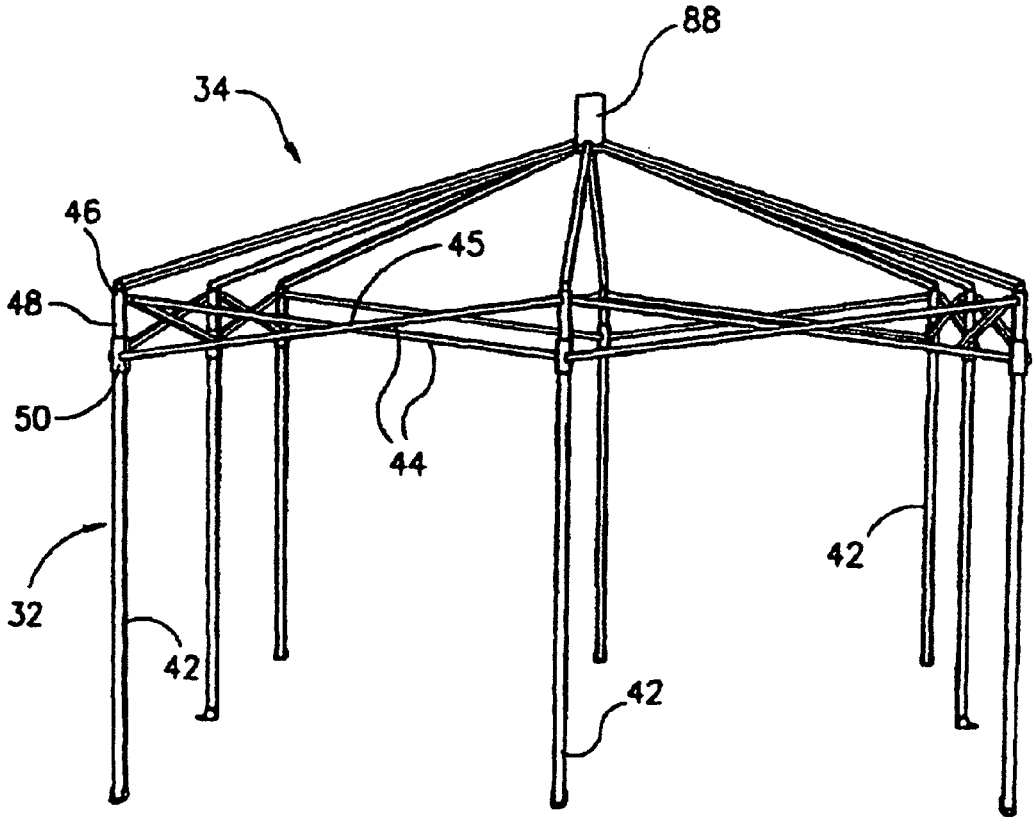
FIG. 6 is an enlarged front perspective view of the shelter frame of FIG. 3 shown in an expanded position, and a roof frame being shown in an expanded position attached to the top of the shelter frame.

Deployment of the shelter assembly 30 includes deploying the shelter frame 32 and roof frame 34 to form the internal framework before the wall panels 38 or roof cover 36 are installed. FIG. 4 shows the shelter frame 32 in a collapsed position, FIG. 5 shows the shelter frame in an intermediate, partially expanded position, and FIG. 6 shows the shelter frame in the fully expanded position with the roof frame 34. The shelter frame 32 of the illustrated embodiment has eight vertical support legs 42, each connected to a pair of scissoring cross members 44. In one embodiment, the support legs 42 and scissoring cross members 44 are lightweight, fiberglass tubes, each with a substantially square cross-sectional shape. As best seen in FIGS. 4 and 5, each pair of scissoring cross members 44 are pivotally interconnected at middle portions 45 of each cross member, so the cross members scissors with respect to each other as the shelter frame 32 is expanded.

Each of the scissoring cross members 44 are securely but pivotally connected at an upper end 46 to an upper end 48 of a respective support leg 42. The bottom end 50 of each scissoring cross member is slidably connected to an adjacent one of the support legs 42 at an intermediate position below the upper end 48 spaced apart from the first support leg. When the shelter frame 32 is in the collapsed position (FIG. 4), the support legs 42 are all nested immediately next to each other, and the bottom end 50 of each cross member 44 is spaced away from the upper end 48 of the of the respective support leg 42. As the shelter frame 32 is moved from the collapsed position (FIG. 4) through the intermediate position (FIG. 5) toward the expanded position (FIG. 6), each pair of cross members 44 scissors about their middle portions 45, thereby sliding the bottom end 50 of each cross member 44 upwardly along the respective support leg 42 toward its upper end 48.

Figure 7:
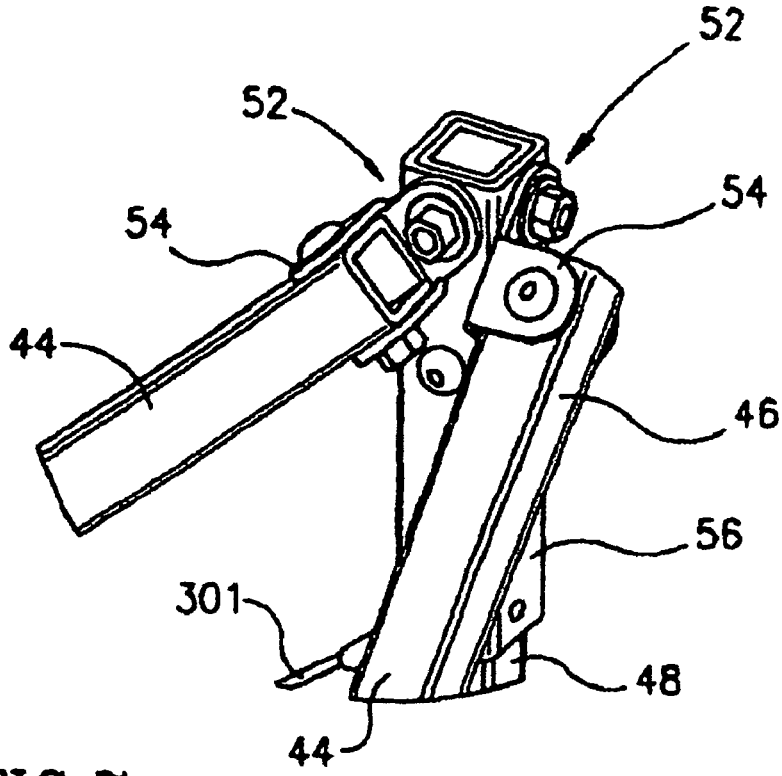
FIG. 7 is an enlarged isometric view of a top connection bracket connecting the vertical support leg and two cross members of the shelter frame of FIG. 3.

FIG. 7 is an enlarged isometric view showing the upper end 48 of a support leg 42 that includes connecting bracketry 52 that pivotally connects to two of the cross members 44. The bracketry 52 includes a pair of U-joints 54 that pivotally attach to the upper end 46 of each cross member 44 and also pivotally attached to a body portion 56 of the bracketry. The bracketry's body portion 56 is bolted or otherwise affixed to the support leg's upper end 48. As the shelter frame 32 is moved toward the expanded position, each cross member's upper end 46 pivots at the respective U-joint 54, and the U-joint also rotates relative to the bracket's body portion 56. Accordingly, the bracketry 52 allows for the relatively complex movement of the support legs 42 and the respective scissoring cross members 34. In the illustrated embodiment, the bracketry 52 is a metal component fastened to the fiberglass support legs and cross members. Other embodiments can use brackets made of other sufficiently durable material.

Figure 8:
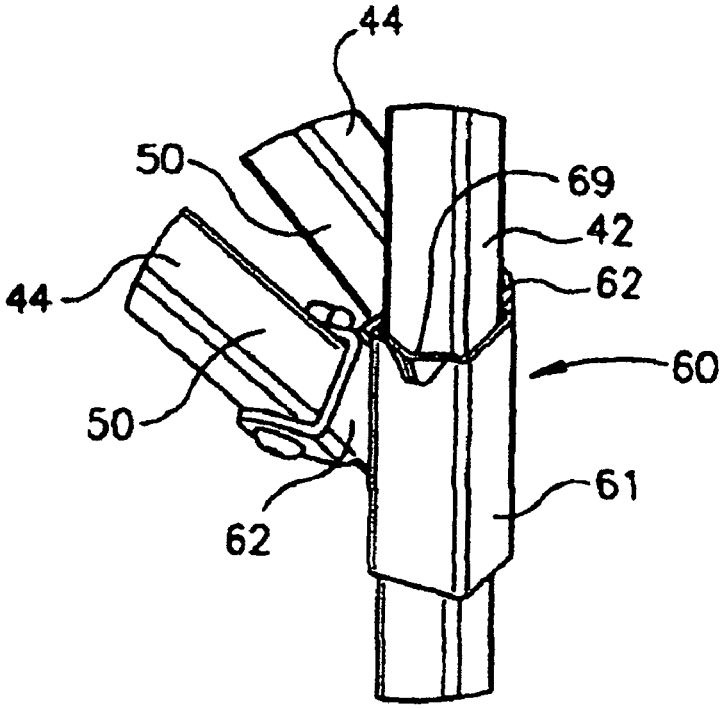
FIG. 8 is an enlarged isometric view of a sliding bottom connection bracket connecting the vertical leg and two cross members of the shelter frame of FIG. 3.

FIG. 8 is an enlarged isometric view showing the bottom ends 50 of the cross members 44 connected to a sliding bracket 60 that slides over the respective support leg 42. The sliding bracket 60 of the illustrated embodiment includes body 61 formed by a metallic sleeve that extends around the support leg 42, although other sufficiently durable materials can be used in other embodiments. The sliding bracket's body 61 is pivotally connected to two U-brackets 62 that are pivotally connected to the lower ends 50 of the respective cross members 44. As the cross members 44 are scissoring when the shelter frame 32 is moving between the collapsed and expanded positions, the sliding bracket 60 slides axially over the respective support leg 42. The U-brackets 62 pivot relative to the body 61 to accommodate the movement of the cross members 44. Accordingly, the shelter frame 32 easily and smoothly moves between the collapsed and expanded positions.

Figure 9:
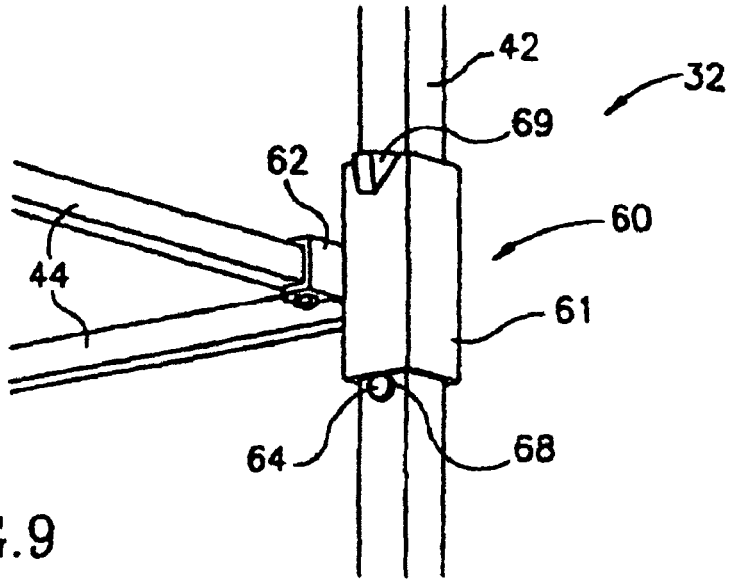
FIG. 9 is an enlarged isometric view showing a sliding connection and spring-biased locking pin arrangement between a vertical support leg and cross members of the shelter frame of FIG. 3.

FIG. 9 shows an enlarged isometric view showing the sliding bracket 60 and a quick-disconnect spring pin 64 mounted in one of the support legs 42. The spring pin 64 releasably retains the sliding bracket 60 in a raised position on support leg 42 when the shelter frame 32 is in the extended position. The spring pin 64 extends through an aperture 68 formed in the support leg 42 and is biased outwardly with a spring member (not shown) contained within the support leg. Sliding bracket 60 has an engagement ramp 69 formed in the top portion of the body 61, so the sliding bracket presses the spring pin 64 inwardly into the aperture 66 as the sliding bracket slides upwardly along the support leg 42 and over the spring pin. Once the sliding bracket 60 moves past the spring pin 64, the spring pin returns to its locking position and blocks the sliding bracket 60 from moving downwardly past the spring pin. When the spring pin 64 is manually depressed into the aperture 68, the sliding bracket 60 can move downwardly along the support leg 42, past the spring pin, thereby allowing the shelter frame 32 to move from the expanded position to the collapsed position.

In operation, the shelter frame 32 is stored in the collapsed position, shown in FIG. 4, so all of the support legs 42 are nested together and the slide brackets 60 are in a lowered position on the respective support legs 42. When the shelter frame 32 is expanded, the support legs 42 move away from each other, thereby causing the cross members 44 to scissors, so the slide brackets 60 move axially along the respective support legs until the slide brackets move over and past the spring pins 64. The spring pins 64 snap into the locked position, thereby retaining the cross members and the support legs 42 in the fully expanded position. To collapse the shelter frame 32, a user simply presses the spring pins 64 into the apertures 68 and moves the sliding brackets 60 axially along the support legs. Accordingly, the cross members 44 scissors relative to each other, thereby pulling the support legs 42 toward each other to the collapsed position. Therefore, the shelter frame 32 can be expanded and collapsed easily and quickly without requiring the use of any tools.

Figure 10:
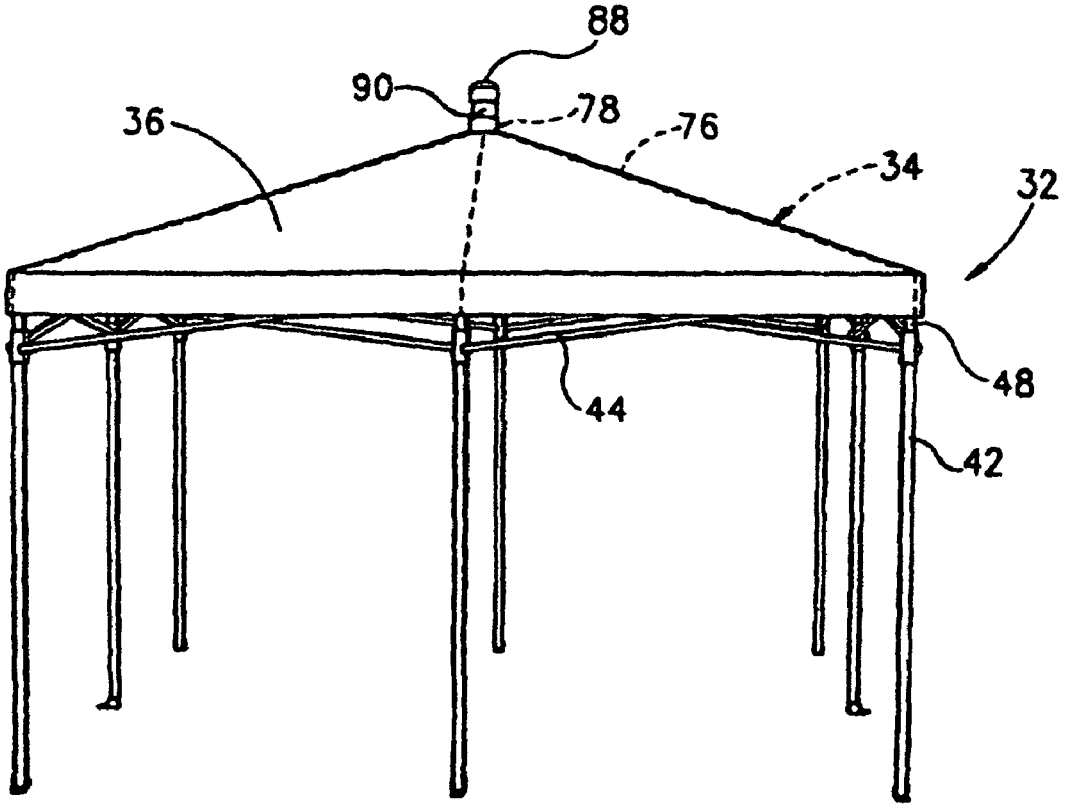
FIG. 10 is an enlarged front perspective view of the shelter and roof frames of FIG. 6 with a roof cover releasably attached to the roof frame.
Figure 11:
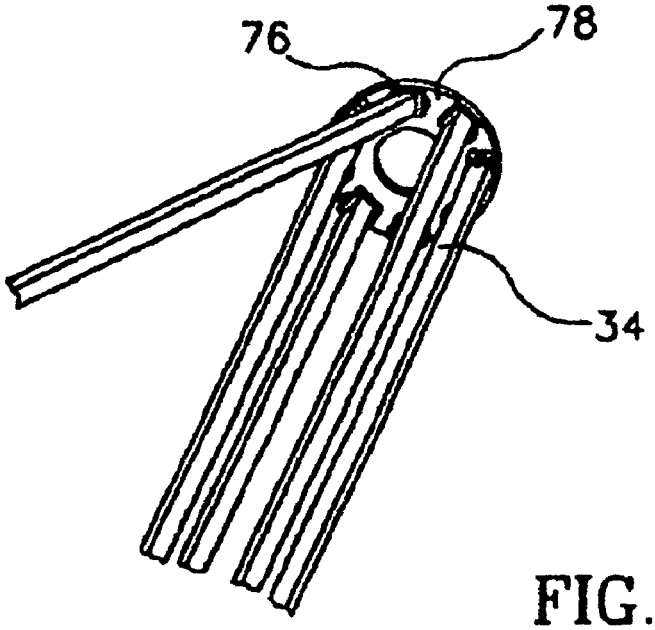
FIG. 11 is an enlarged partial isometric view of the roof frame of FIG. 10 shown in a collapsed position and removed from the shelter frame, and with the cover removed.
Figure 12:
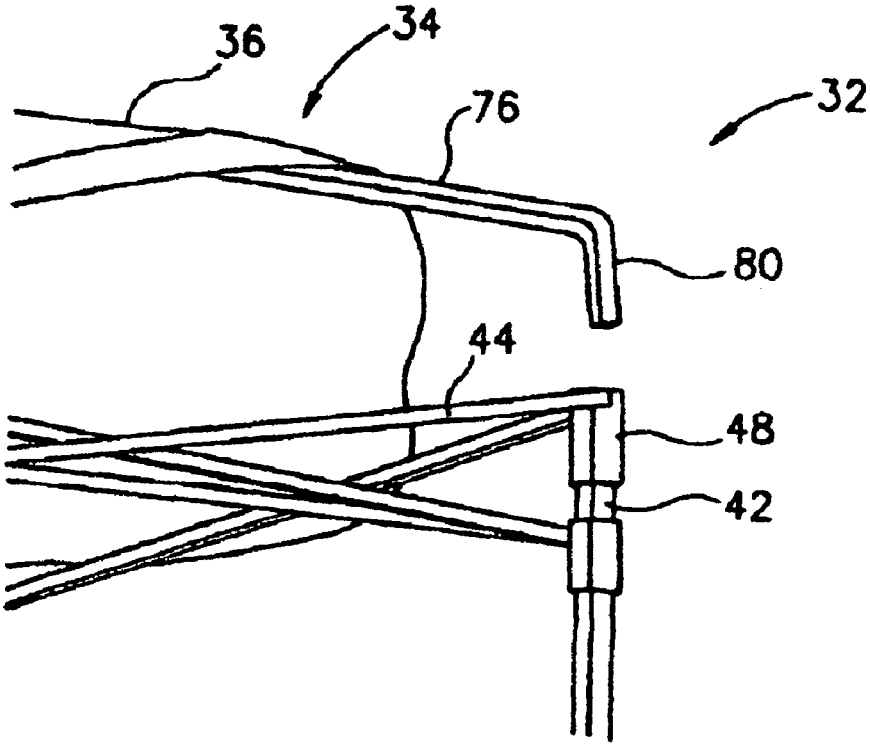
FIG. 12 is an enlarged partially exploded isometric view of portions of the shelter and roof frames of FIG. 6 with one leg of the roof frame removed from the shelter frame.

FIG. 10 shows an enlarged front perspective view of the shelter frame 32 supporting the roof frame 34 that is covered by a roof cover 36. FIG. 11 shows the roof frame 34 in a collapsed positioned with upper end of frame legs 76 pivotally connected to an apex disk 78. The frame legs 76 expand outwardly from a collapsed position illustrated in FIG. 11 to an expanded position, shown in the FIG. 10, so the roof frame 34 generally has a pyramid shape. FIG. 12 shows free ends 80 of the roof frame's legs 76 that attach to the upper ends 48 of the shelter frame's support legs 42. The upper ends 48 of the support legs 42 have apertures 82 therein that removably receive the free ends 80 of the roof frame's legs 76. Accordingly, the roof frame 34 is removably attached to the top of the shelter frame 32 by plugging the roof frame's legs 76 into the top of the support legs 42 without requiring any tools for assembly. In the illustrated embodiment, the frame legs 76 of the roof frame 34 are made of the same fiberglass tubes that form the shelter frame 32.

Figure 13:
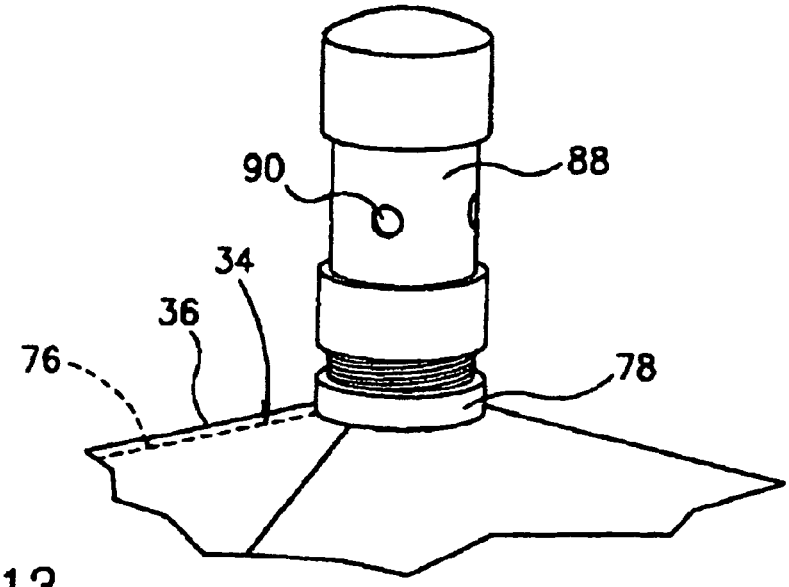
FIG. 13 is an enlarged isometric view of a vent cap threadably attached to the roof frame of FIG. 6.

As best seen in FIG. 13, a vent cap 88 is threadably attached to the apex disk 78 on the top of the roof frame 34. The vent cap 88 is cylindrical with a closed top end and apertures 90 in the sides that allow air to flow through the vent cap and into or out of the shelter assembly 30, while keeping rain, snow, dust and the like out. The vent cap 88, thus, provides an "all weather" element protection while venting the shelter assembly 30.

Figure 14:
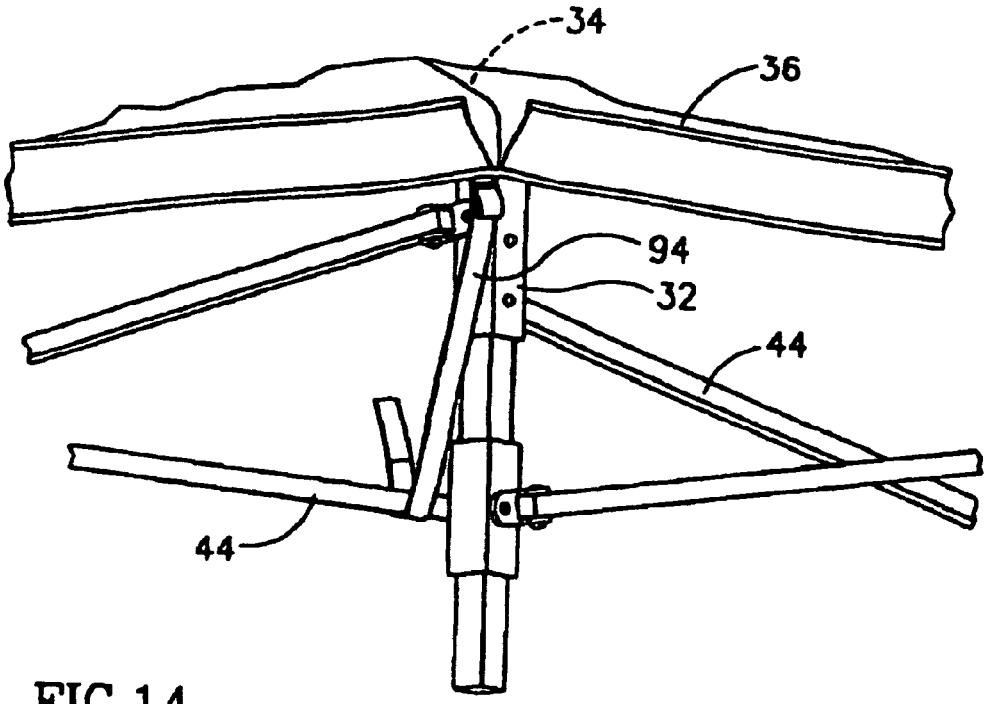
FIG. 14 is an enlarged front perspective view showing the attachment strap of the roof cover of FIG. 10 attached to the shelter frame.

As best seen in FIGS. 10 and 14 the roof cover 36 is a removable cover that extends over and fully encloses the roof frame 34. The roof cover 36 in the illustrated embodiment is a waterproof and windproof cloth-like material that can be easily folded into a compact bundle for easy storage. A plurality of straps 94 (FIG. 14) attached to lower edges of the roof cover 36 are removably attached to the cross members 44 to securely retain the roof cover on the roof frame 34. The straps 94 also work to securely hold the roof frame 34 on the shelter frame 32. The straps 94 can include buckles, quick clips, hook-and-loop fasteners, or other attachment configurations to allow the straps to securely retain roof cover 36 to the shelter frame 32 and over the roof frame 34.

Figure 15:
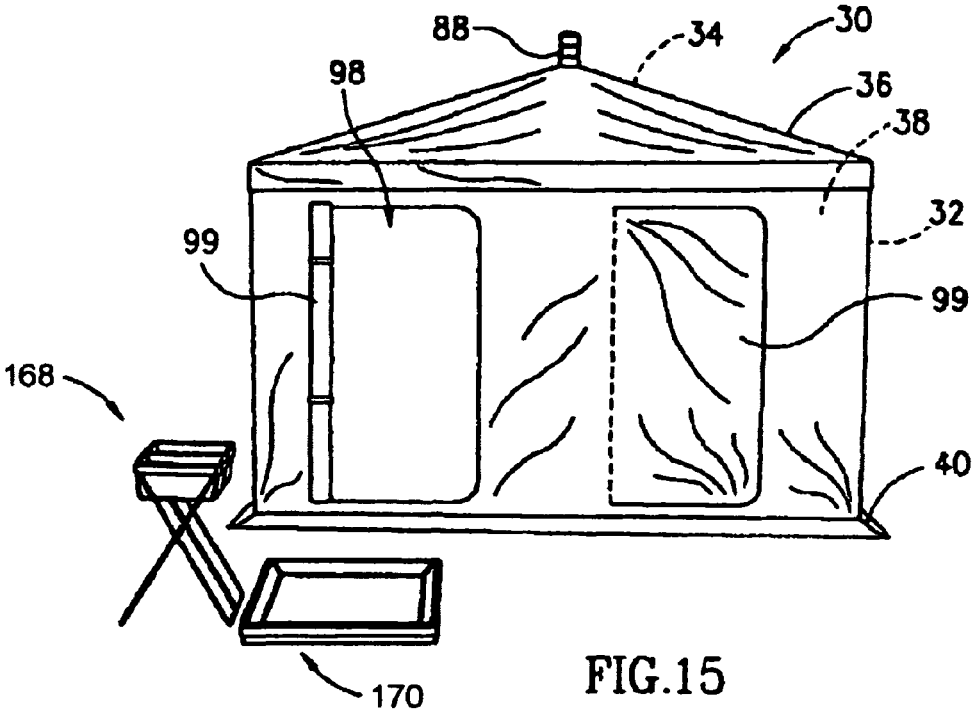
FIG. 15 is a front perspective view of the shelter assembly of FIG. 3 with side covers on the shelter frame, a shuffle box assembly and wash tub assemblies being shown adjacent to an open door of the shelter assembly.

FIG. 15 is a front perspective view of the shelter assembly 30 with the wall panels 38 removably attached to the shelter frame 32 and the roof cover 36 on the roof frame 34 to form a fully enclosed shelter. The wall panels 38 are made of a flexible, waterproof and windproof cloth-like material, so the panels can be easily folded into a compact bundle for easy storage. The wall panels 38 can have cutouts 98 with flaps 99 that can be moved between open and closed positions to form doors or windows in the shelter assembly 30. The wall panels 38 of the illustrated embodiment extend along the entire height of the shelter frame 32 from the roof cover 36 to the run-off flaps 40.

Figure 16:
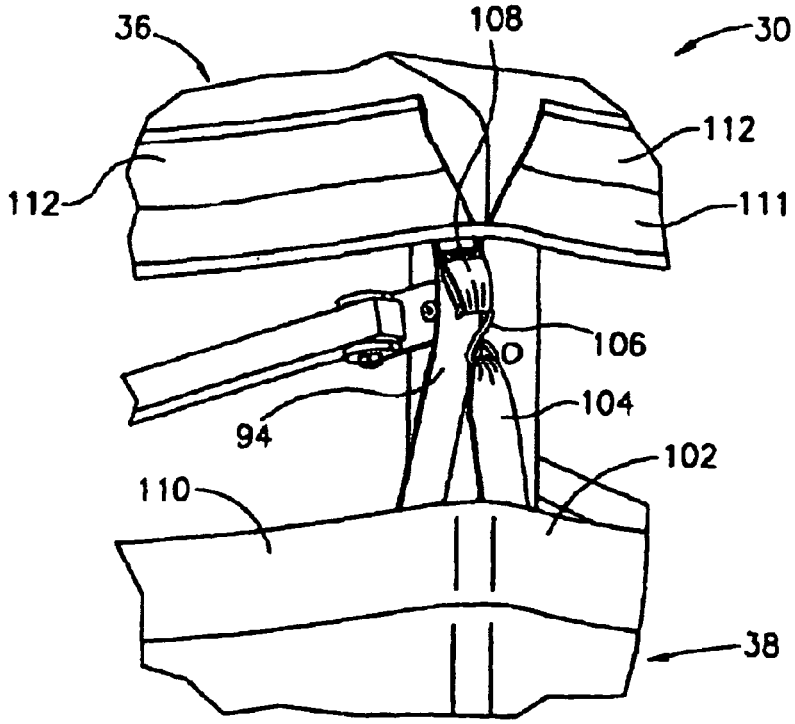
FIG. 16 is an enlarged partial isometric view showing the attachment configuration of the side covers of the shelter assembly of FIG. 15 and a roof cover.

As best seen in FIG. 16, the top edges 102 of wall panels 38 are adjacent to the roof cover 36. A plurality of connector straps 104 each with a hook 106 thereon are connected to the top edges 102. The hooks 106 removably attach to loops 108 on the roof cover 36. Accordingly, the wall panels 38 can be easily and quickly hooked onto the roof cover 36. The top edges 102 of the wall panels 38 also have a fastener strip 110 of hook or loop material, and the lower edges 111 of the roof cover 36 (shown in FIG. 16 lifted away from the wall panel's top edges for illustrative purposes) have the mating fastener strip 112 of loop or hook material. The fastener strips 110 and 112 releasably attach to each other to form a substantially weather tight seal between the wall panels 38 and the roof cover 36 and to help hold the wall panels adjacent to the shelter frame. The hooks 106, straps 108 and the fastener strips 110 and 112 allow the wall panels to be easily and quickly installed on the shelter assembly 30 during the set up of the decontamination system 10 (FIG. 1) without requiring special tools for the setting up the system. The shelter assembly 30 can also be disassembled quickly and easily without requiring tools. While the illustrated embodiment uses hooks 106, straps 108, and hook-and-loop fastening strips, other connection devices can be used in alternative embodiments, such as snaps, zippers, quarter-turn fasteners or the like.

The shelter assembly 30 is one of the major components of the decontamination and contaminant system 10, and as shown in FIG. 1, is one of the central components of the system's first station 16. Other components 20 of the system making up the various stations are discussed in greater detail below in connection with the respective station in which the components are used. The decontamination and containment system 10 can be set up with multiple stations for the decontamination process. As best seen in FIG. 1, the first station 16 is positioned adjacent to an entrance 122 to the decontamination area 12. The first station 16 of the illustrated embodiment of FIG. 1 includes an initial decontamination area 124, a weapons clearing area 125, a wash and hold area 126, and an external equipment removal area 128. It is noted that the stations of the decontamination system 10 and components in those stations can be set up to provide a variety of station configurations to accomplish the particular decontamination process required for a given situation. Thus, the decontamination system 10 illustrated in FIG. 1 is an illustrative example showing one embodiment of station configurations that can be used for a selected decontamination process.

Figure 17:
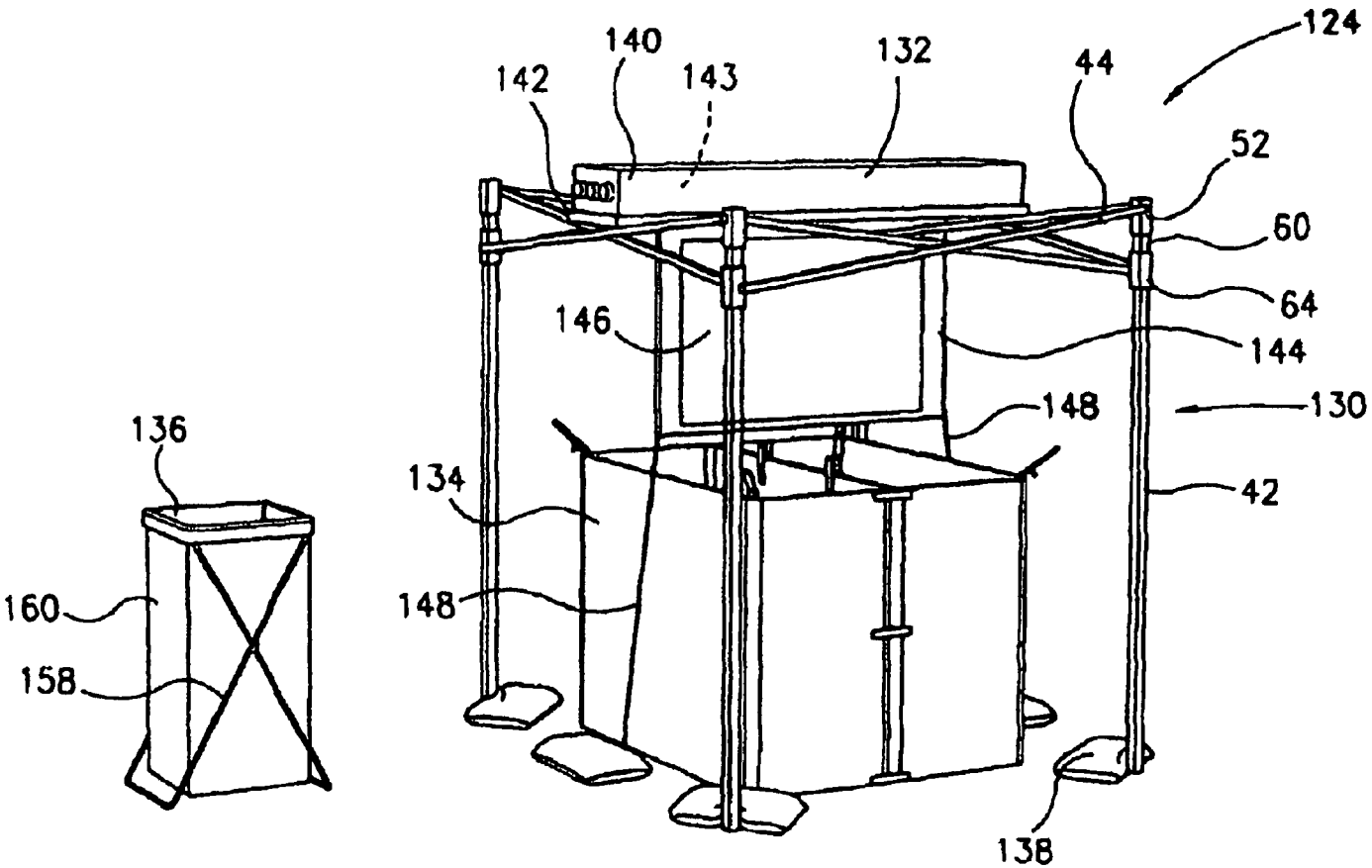
FIG. 17 is a front isometric view of a station frame in an expanded position, with a hamper assembly and signage assembly mounted to the station frame.

As best seen in FIG. 17, the initial decontamination area 124 of the illustrated embodiment includes a signage assembly 132 mounted on a station frame 130, a dual hamper assembly 134 connected to the station frame, and a collapsible trash hamper 136 adjacent to the station frame. The station frame 130 is a collapsible, lightweight frame having a configuration very similar to the shelter frame 32 discussed above and illustrated in FIGS. 6 and 10. The station frame 130, however, is smaller and only has four support legs 42 interconnected with the scissoring cross members. The station frame 130 is also constructed with the fiberglass tubes that are used to construct the shelter assembly. As the station frame 130 is moved between the expanded and collapsed positions, the sliding bracket 60 moves axially along the respective support leg 22 as the upper bracketry 52 allows the cross members 44 to pivot relative to the support legs 42. The sliding bracket 60 is releasably retained by the spring pins 64 when the station frame 130 is in the expanded position as shown in FIG. 17. The support legs 42 and station frame 130 can be anchored to the ground with stakes (not shown), sandbags 138 (as illustrated), weights, or the like.

The signage assembly 132 mounted on the station frame 130 has a sign box 140 supported on a pair of cross bars 142 that rest on top of opposing cross members 44. The sign box 140 contains a pull-down sign support 144 that provides flat surfaces on opposing sides to which a selected sign, map, informational placard, or other visual display 146 can also be removably attached. The selected visual display 146 is positioned to provide information to personnel entering the initial decontamination area 124. The lower corners of the sign support 144 are connected to tether lines 148 that can be anchored to the ground to hold the sign support in a downward extended position. The tether lines 148 also help prevent the sign support 140 from flapping in the wind when the sign support is pulled down into the extended position.

The sign support 144 is connected to a spring reel 143 contained in the sign box 140. The spring reel 143 is angularly biased to automatically roll the sign support 144 into the sign box 140 when the tether lines 148 are released. Thus, the sign support 144 is stored in the sign box 140 when not in use. The sign box 140 is sized to removably contain a variety of selected signs, maps, instructional placards or other visual display that can be removably attached to the sign support 144. Accordingly, the visual information provided to the personnel can be easily and quickly changed by replacing one visual display 146 with another one from the sign box 140. The visual displays 146 can be retained on the sign support with clips, magnets, adhesive strips, hook-and-loop fasteners, or other suitable connection mechanisms. In an alternate embodiment, the sign support 144 can also have a reflective coating on it so the sign support can be used as a projection screen. Thus, information can be actively displayed on the signage assembly 132 via a projection system or other multimedia system.

Figure 18:
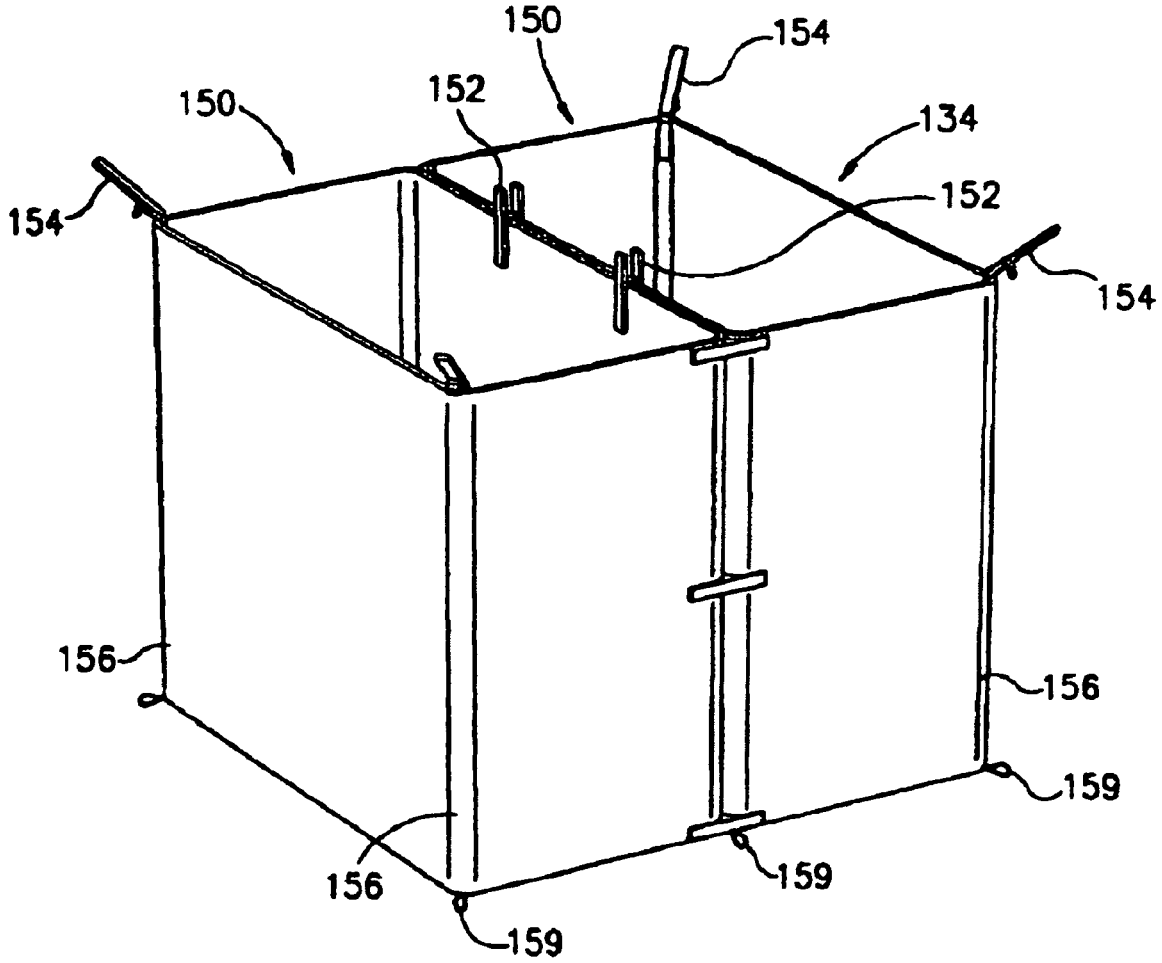
FIG. 18 is an enlarged top isometric view of the hamper assembly of FIG. 17 shown removed from the station frame for purposes of clarity.

The signage assembly 132 is positioned above the dual hamper assembly 134 with the station frame 130. FIG. 18 illustrates the dual hamper 134 in an expanded position and removed from the station frame 130. The dual hamper 134 is a soft, flexible collapsible hamper configuration with two hamper receptacles 150 removably attached to each other by connector clips 152. The hamper receptacles 150 each also have connection straps 154 connected to the two outer corners.

As best seen in FIG. 18, the connections straps 154 releasably attach to the support legs 42 of the station frame 130 to hold the hamper receptacles in an upward, expanded position. The hamper receptacles 150 are sized to allow selected items, particularly contaminated items, to be deposited into them so as to contain the contaminates on those items in a controlled area. The lower corners 156 of the hamper receptacles 150 have connection loops 159 that can be used to stake or otherwise hold the hamper receptacles on the ground. The hamper receptacles 150 can be easily and quickly installed onto the station frame 130 in the expanded position ready to receive the selected items from the personnel. When the hamper receptacles 150 are full or need to be replaced, the selected hamper receptacle can be easily removed from the shelter frame, separated from the other receptacle and replaced.

FIG. 17 also illustrates the collapsible trash hamper 136 that includes a collapsible, scissoring hamper frame 158 that supports a flexible, collapsible hamper bag 160. The hamper frame 158 is movable between an expanded position and a flat, collapsed position (not shown). The hamper frame 158 holds the hamper bag 160 in an open position so as to receive trash or other discarded items. In the illustrated embodiment, the hamper bag 160 is a soft, flexible treated cloth bag, although other materials, such as plastic, can be used. Accordingly, the hamper bag 160 can be collapsed and stored in a very compact manner. When the hamper bag 160 is full, it can be removed from the hamper frame 158 and replaced with a new hamper bag.

Figure 19:
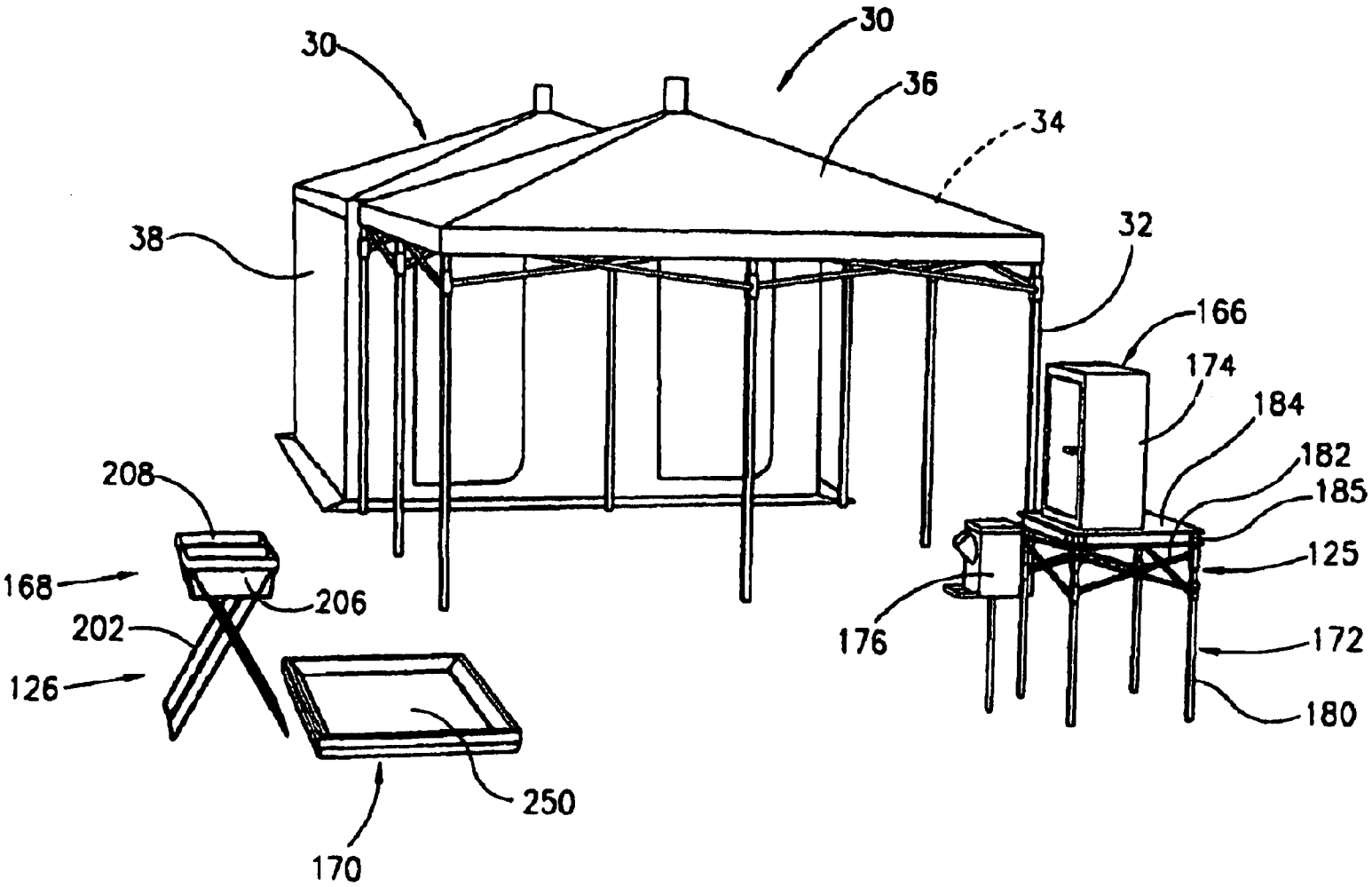
FIG. 19 is a front perspective view of a first station of the system of FIG. 1, the first station providing a weapon clearing and wash/hold area having a weapon clearing assembly, a wash tub assembly, a shuffle box assembly, and a shelter assembly in accordance with one embodiment of the invention.
Figure 20:
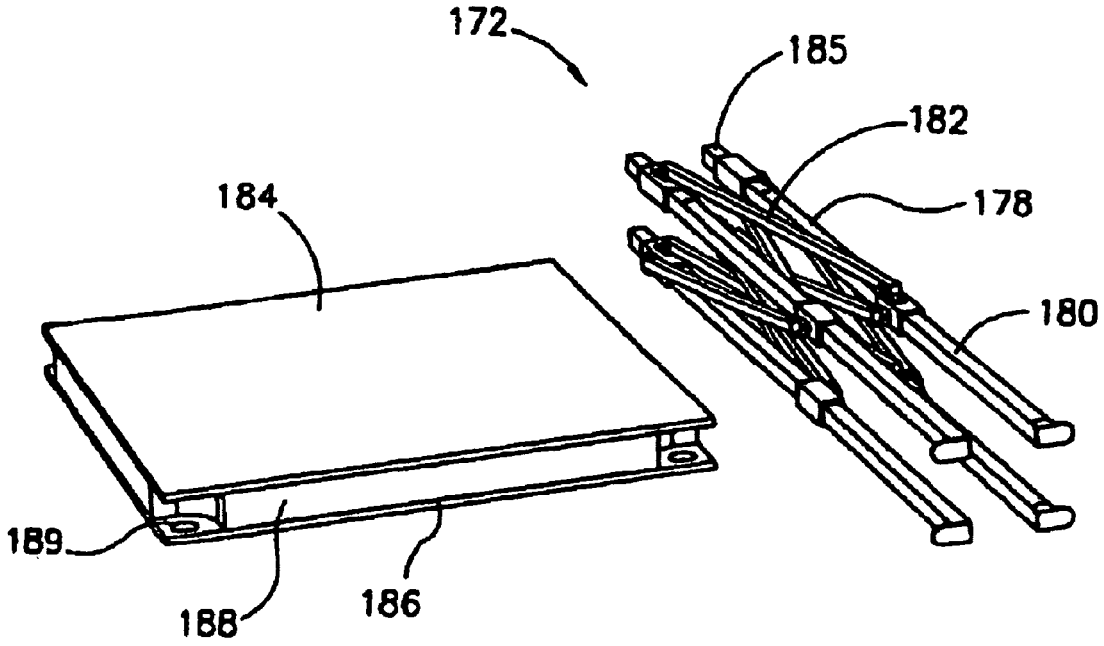
FIG. 20 is an enlarged view of the collapsible stand of the weapon clearing assembly of FIG. 19, the stand being shown in a collapsed position with the tabletop separated from the table frame.

FIG. 19 is a front perspective view showing the weapons clearing area 125 and the wash and hold area 126 of the first station 160. The weapons clearing area 126 includes a weapons clearing and storing assembly 166 having a collapsible stand 172 that supports a weapons storage locker 174 and a weapons clearing box 176. As best seen in FIGS. 19 and 20, the stand 172 includes a collapsible base 178 that is movable between a stored position (FIG. 20) and an expanded position (FIG. 19). The base 178 of the illustrated embodiment includes four vertical legs 180 interconnected by scissoring cross members 182. The scissoring cross members 182 are pivotally and slidably attached to the vertical legs so as to move in a scissoring action when the base 178 is moved between the collapsed and expanded positions. The cross members 182 are slidably connected to the vertical legs 180 and operate in the same manner as the shelter frame 32 and the station frame 130 discussed above. Thus, the collapsible base 178 can be moved into the expanded position and locked into place with the spring pins as discussed above without requiring tools for assembly. The base 178, similarly, can be quickly and easily collapsed and stored without requiring tools for the disassembly.

Figure 21:
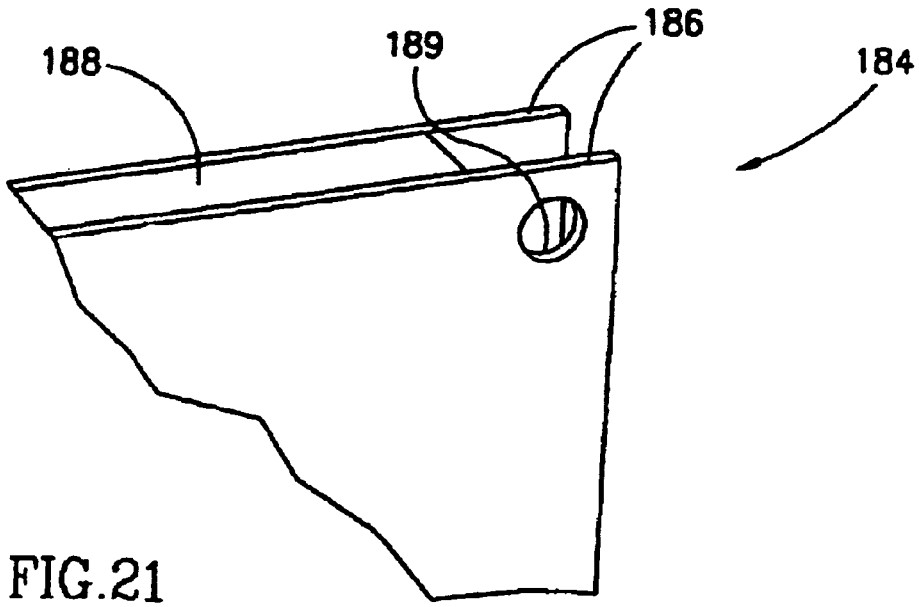
FIG. 21 is an enlarged bottom perspective view of a corner of the table top of FIG. 18.

When the stand 172 is in the expanded position, the top of the vertical legs 180 support a flat tabletop 184 removably attached to the base 178. In the illustrated embodiment, the top of the vertical legs 180 each have a small projection member 185 extending upwardly when the base 178 is expanded. As best seen in FIG. 21, the tabletop 184 is made of two spaced apart plate members 186 with separate blocks 188 sandwiched therebetween. Apertures 189 are formed in the corners of the lower plate member 188. When the table top 184 is placed onto the base 178, the projections 185 extend into the apertures 189 in the tabletop's lower plate member 188. The projection members 185 prevent the tabletop 184 from sliding off of the top of the base 178. The tabletop 184 with the apertures 189 therein allows for very quick and easy assembly of the stand 172 without requiring any tools.

Figure 22:
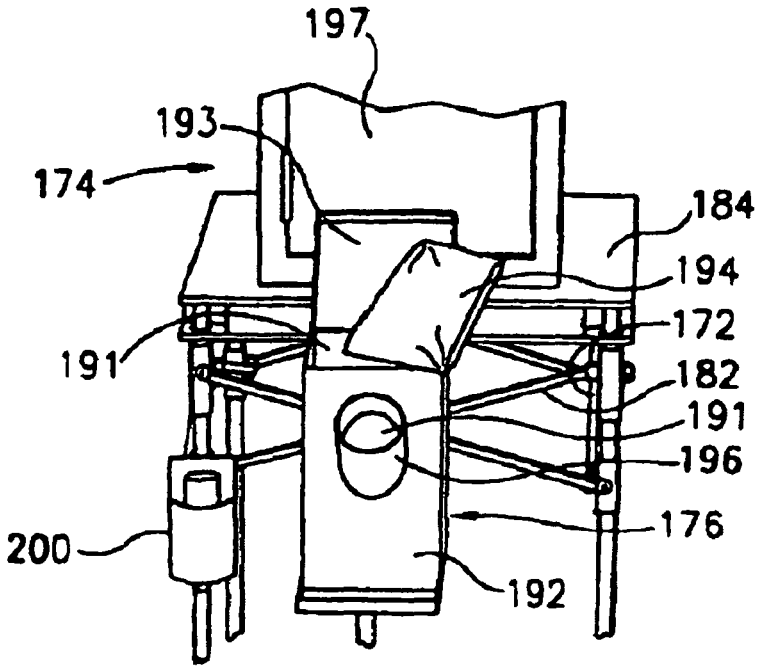
FIG. 22 is a partially exploded top perspective view of a weapon clearing box of the weapon clearing assembly of FIG. 19.

As best seen in FIGS. 19 and 22, the weapons clearing box 176 is mounted to the front side of the collapsible stand 172 below the tabletop 184. In the illustrated embodiment, the rear side of the weapons clearing box 176 has a pair of hooks (not shown) that removably hook onto a stand's front set of cross members 182. Accordingly, the weapons clearing box 176 can be quickly and easily attached to or removed from the stand 172.

Referring now to FIG. 22, the weapons clearing box 176 has an outer metal container 192 that removably contains a rigid ballistic plate 191 and one or more ballistic absorption packs 194. A lid 193 is pivotally attached to the outer container 192 to allow for easy access to the outer container's interior area and the ballistic absorption packs 194. In one embodiment, the outer metal container 192 is made of 16 gauge stainless steel. While one of the ballistic absorption packs 194 is shown in FIG. 22 removed from the outer container 192 for purposes of illustration, the ballistic absorption packs are fully contained within the outer container's interior area when the weapons clearing box is in use. The ballistic plate 191 includes an inner plate covered with composite fiber material to provide a structure that can substantially decelerate or stop a bullet. The ballistic absorption packs 194 are constructed with multiple layers of bulletproof material so the pack will stop a bullet discharged into it. In one embodiment, the ballistic absorption packs include soft armor, such as UDX1000 Composite Armor manufactured by Survival Inc., of Seattle, Wash.

The outer container 192 has a cylindrical firing tube 196 that communicates with the container's interior area and is aligned with the ballistic absorption packs 194. The firing tube 196 is shaped and sized to receive the barrel of a weapon, such as a side arm, so the barrel points at the ballistic plate 191 and the ballistic absorption pack 194. In operation, each personnel, such as a soldier or the like entering the first station 16 with a weapon moves to the weapons clearing assembly 166, and aims the barrel of the weapon into the firing tube 196 toward the ballistic absorption packs 194. The user then confirms that the weapon's chamber is clear of ammunition by attempting to fire the weapon. Most often, the weapon will be clear and nothing will occur in the weapon clearing box 176.

In the event the weapon is fired and discharges a round that was not properly cleared, the bullet will strike the ballistic plate 191 and, if the bullet penetrates the plate, the bullet enters the ballistic absorption packs 194 until it is stopped while fully contained within the weapons clearing box 176. Once a round is fired into the ballistic plate 191 and the ballistic absorption packs 194, the plate and packs must be removed and replaced with a new ballistic plate 191 and ballistic absorption pack 194. A lid 193 is pivotally attached to the outer container 192 to allow for easy access to the outer container's interior area and the ballistic absorption packs 194.

Figure 23:
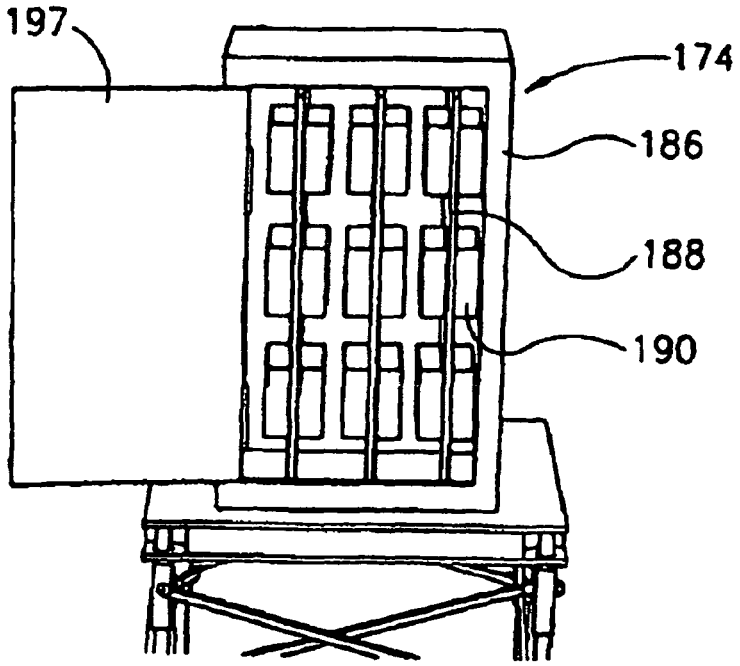
FIG. 23 is an enlarged front elevation view of the weapon storage locker of the weapon clearing assembly of FIG. 19, the locker being shown open with storage plates and weapon retaining straps within the locker.

After the personnel insure that the weapon is clear, the weapon is stored in the weapons storage locker 174. The weapons storage locker 174 removably sits on top of the stands tabletop 184. As best seen in FIG. 23, the weapons storage locker 174 has an outer case 186 that removably retains a plurality of storage plates 188 in the case's interior area. The storage plates 188 are vertically oriented and slide into and out of the outer case 186 along internal tracks (not shown). The storage plates 188 each have a plurality a retention members 190 removably mounted on opposing sides of the respective storage plate. The retention straps 190 of the illustrated embodiment are holsters and clip holders shaped and sized to removably retain sidearms, ammunition clips, and other selected weapon components. Thus, the weapons are safely stored on the storage plates 188 and fully contained within the outer case 186. The outer case 186 includes a door 197 that can be closed and locked to securely enclose the weapons in the storage locker 174.

The weapon clearing assembly 166 of the illustrated embodiment has a liquid/powder dispenser assembly 200 removably attached to the collapsible base 178 adjacent to the weapons clearing box 176. The liquid/powder dispenser assembly 200 is provided to allow personnel to dispense a selected neutralizing liquid or powder on his or her hands or on a weapon before placing the weapon into the weapon storage locker 174. The liquid/powder dispenser assembly 200 is discussed in greater detail below.

The wash and holding area 126 includes a pair of wash tub assemblies 168 and a shuffle box assembly 170 adjacent to the wash tub assemblies. A pair of the shelter assemblies 30 are positioned generally downstream of the wash tub assemblies 168 and shuffle box assembly 170. In the illustrated embodiment, one shelter assembly 30 includes shelter frame 32, roof frame 34, and the roof cover 36, but does not include the wall panels 38 discussed above. The second adjacent shelter assembly 30 includes the roof cover 36 and wall panels 38 to provide a fully enclosed shelter in which contaminated personnel are initially treated with a dusting agent and/or a decontamination/neutralizing agent. The dusting agent can be "Fullers Earth," which is a highly refined clay, and the decontamination/neutralizing agent can be a chlorine spray. The dry dusting agent can help identify any "wet" contaminated areas and to stabilize the wet areas or droplets. The decontamination/neutralizing spray is adapted to help reduce the risk of potential harm to the contaminated personnel and any attendants or other processing personnel. The initial treatment in one embodiment utilizes a large, full-body, lightweight plastic tube bag sealed on one end and lined with a lightweight fabric impregnated with a decontamination/neutralizing agent. The bag is shaped in size to allow the personnel to step into the bag and an attendant pulls the bag up and over the individual. The attendant then rubs the bag over the outside of the contaminated personnel to both decontaminate and neutralize the personnel as well as contain any contaminates from the personnel within the bag. The bag, thus, provides a waterless shower-type application of the decontamination and neutralizing agent. The bag is then opened and lowered around the personnel so the personnel can step out of the bag. The bag is then sealed by the attendant and held for proper HAZMAT disposal. Accordingly, the bag provides an environmentally sound initial treatment while containing potentially hazardous contaminates within the bag so they can be disposed of in a proper manner without contaminating other personnel or attendants. In addition to providing an area for this initial treatment, the shelter assemblies 30 also provide an area where the personnel can rest and wait during the decontamination process before proceeding to the subsequent stations. The shelter assemblies 30 also provide an area where people running the decontamination process can set up administration materials if needed.

Figure 24:
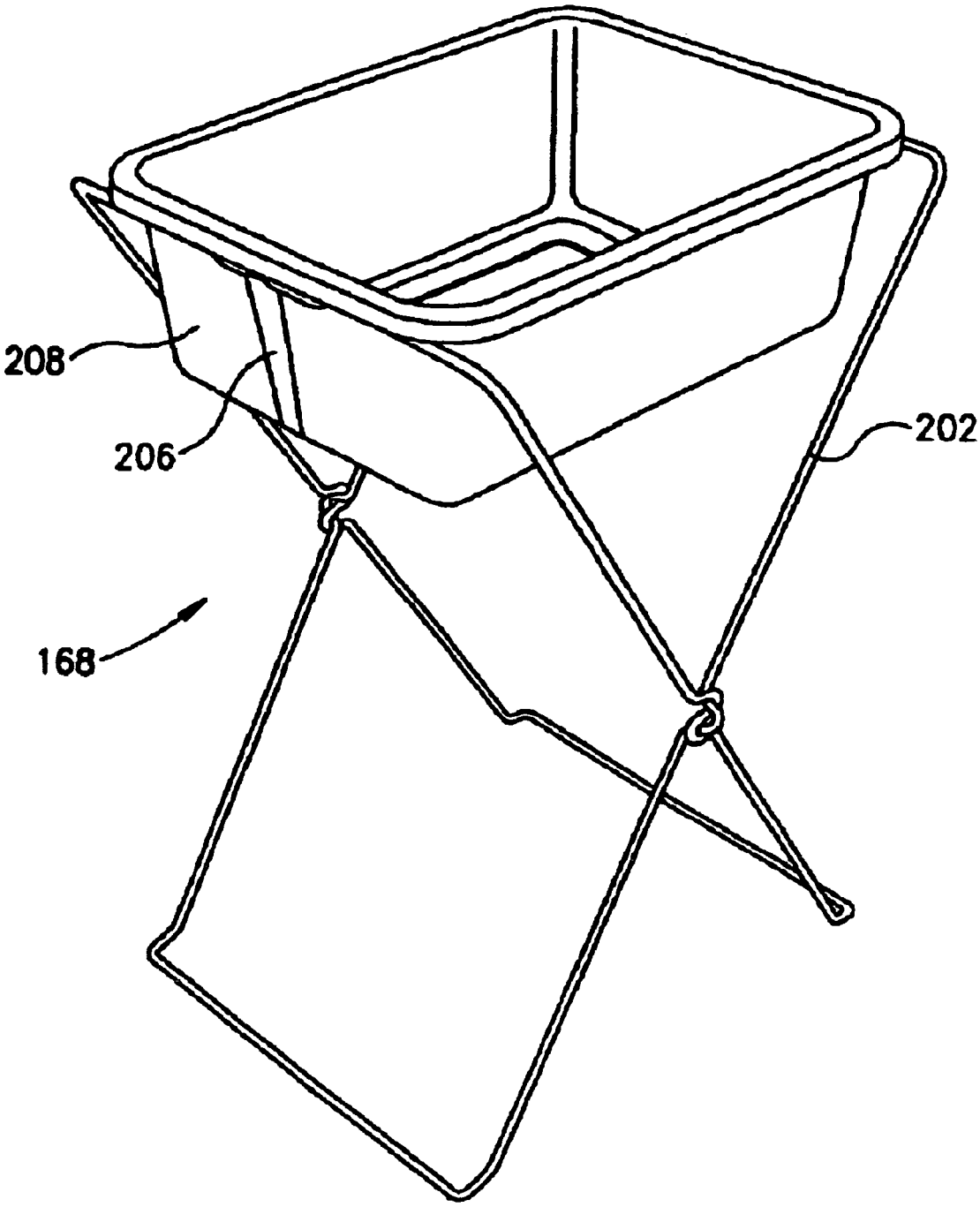
FIG. 24 is an enlarged isometric view of the wash tub assembly of FIG. 19, shown in an expanded position.

The wash tub assemblies 168 are positioned to allow the personnel entering the wash and hold area to wash their hands and arms. As best seen in FIG. 24, the wash tub assemblies 168 has a collapsible stand 202 and movable between a collapsed, substantially flat position (not shown) and an expanded position. A support strap 206 extends between the top portions of the stand, and a wash tub 208 is removably supported by the support strap and the top of the stand. The support strap 206 helps support the wash tub 208 on the stand 202, particularly when the wash tub is filled with water or other selected decontamination/neutralizing solution, such as chlorine or bleach. In one embodiment, the shelter assembly 30 can also be converted into a decontamination tent that includes a plurality of ultraviolet lights. In this embodiment, a bladder is added within the tent and a misting station is also set up to direct a decontaminating mist, such as a formaldehyde fogger or other similar agent, onto the contaminated personnel. The misting station is effective for decontaminating or neutralizing chemical agents. The ultraviolet lights are provided, and when turned on, effectively "cook" biological agents that may have contaminated the personnel. After the personnel has been subjected to the ultraviolet lights or the misting station, the personnel exists the shelter assembly 30 and proceeds with the remaining portion of the decontamination process.

Figure 25:
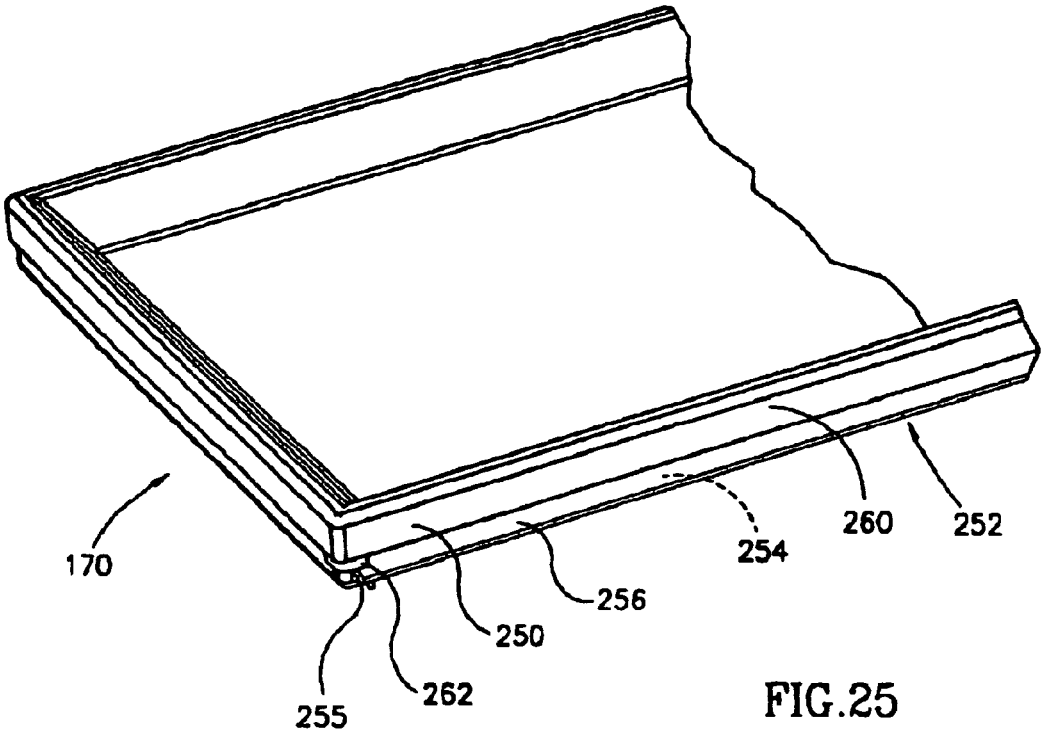
FIG. 25 is an enlarged top isometric view of the shuffle box assembly of FIG. 19 shown in an assembled position.
Figure 26:
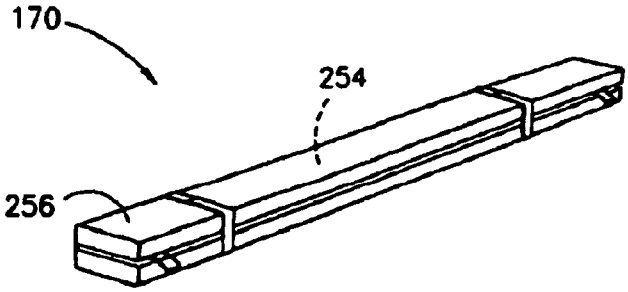
FIG. 26 is an isometric view of the shuffle box assembly of FIG. 19 shown in a collapsed, stored position.
Figure 27:
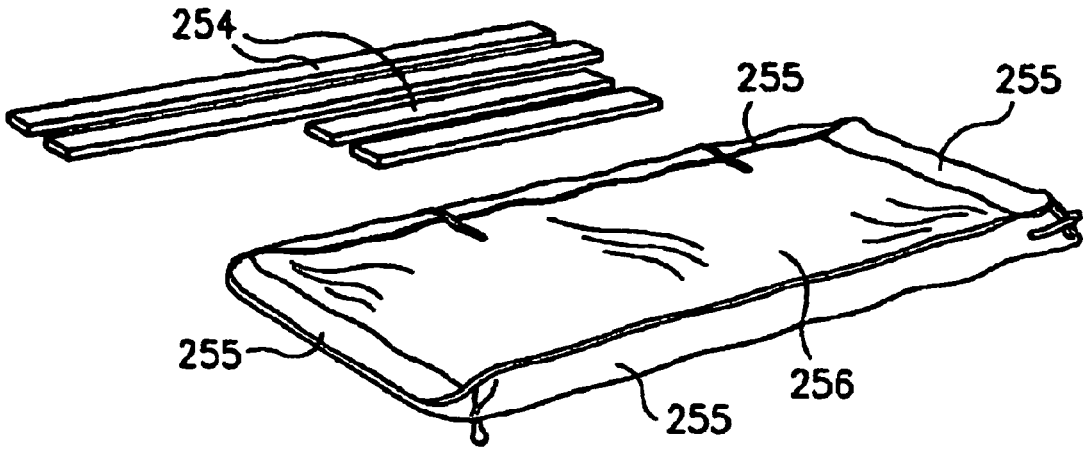
FIG. 27 is an enlarged top isometric view of the shuffle box assembly of FIG. 19 shown in a collapsed and partially disassembled position.

The shuffle box assembly 170 shown in FIG. 16 is adapted to contain a selected dusting agent or decontamination/neutralizing agent and is positioned adjacent to the wash tub assemblies 168, so personnel can step into the shuffle box and the neutralizing agent while using the wash tub assemblies. The personnel shuffles their feet within the shuffle box assembly 170 to get the neutralizing agent onto the personnel's boots, shoes, or other footwear. As best seen in FIG. 25, the shuffle box assembly 170 contains a durable inner bladder 250 removably supported by a shallow, collapsible frame 252 that forms a shallow, open box. In the illustrated embodiment, the inner bladder 250 is made of a durable plastic material that will not rupture or tear when personnel walk or shuffle through the shuffle box. The inner bladder 250 is also disposable so that the bladder can be used during a decontamination process, be appropriately disposed of, and replaced with the new clean bladder for another decontamination process and can be installed on the collapsible frame 250.

As best seen in FIGS. 25-28, the shuffle box assembly 170 can be unpacked and assembled from a compact stored position (FIG. 26) to partially assembled positions (FIGS. 27 and 28) to the fully assembled position (FIG. 25) without requiring the tools for assembly. The collapsible frame 252 of the illustrated embodiment includes four stiff sidewall inserts 254 that are removably retained in pockets 255 formed in the perimeter of a flexible, fabric base 256. When the shuffle box assembly 170 is in the stored position (FIG. 26), the base 256 is rolled around the sidewall insets 254 so as to form a compact elongated unit easily transportable and requires a relatively small amount of storage space.

Figure 28:
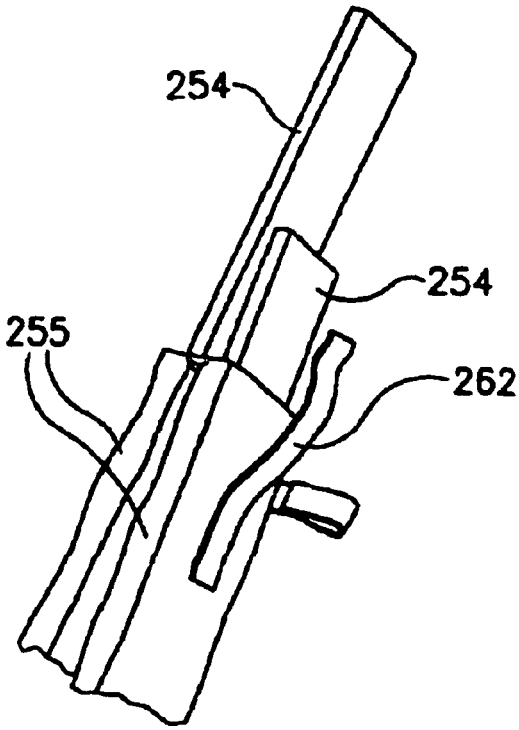
FIG. 28 is an enlarged isometric view of sidewalls partially inserted into a base of the shuffle box assembly of FIG. 19.

Assembly of the collapsible frame 252 is accomplished by unrolling the base 256, removing the sidewall inserts 254, and inserting the sidewall inserts into the pockets 255 (FIG. 28). When all four of the sidewall inserts 254 are positioned into the respective pockets 255, the four sidewalls 260 of the base 256 are retained in a vertical position to form the shallow open box. The sidewall inserts 254 are each retained within their respective pockets 255 by a retention strap 262 that can be easily fastened to close the pocket openings.

In the illustrated embodiment, the ends of the sidewall inserts 254 and pockets 255 are positioned at the corners of the frame 252, so that if someone steps on one of the vertical sidewalls 260, the sidewall can be flattened onto the ground without being damaged and without damaging the frame's other sidewalls. If one of the sidewalls 260 is flattened, it automatically returns to the vertical upright position because of the interconnection with the other sidewalls that were not flattened. Accordingly, the collapsible frame 252 is very durable and easy to use, as well as being easy to assemble and disassemble.

Figure 29:
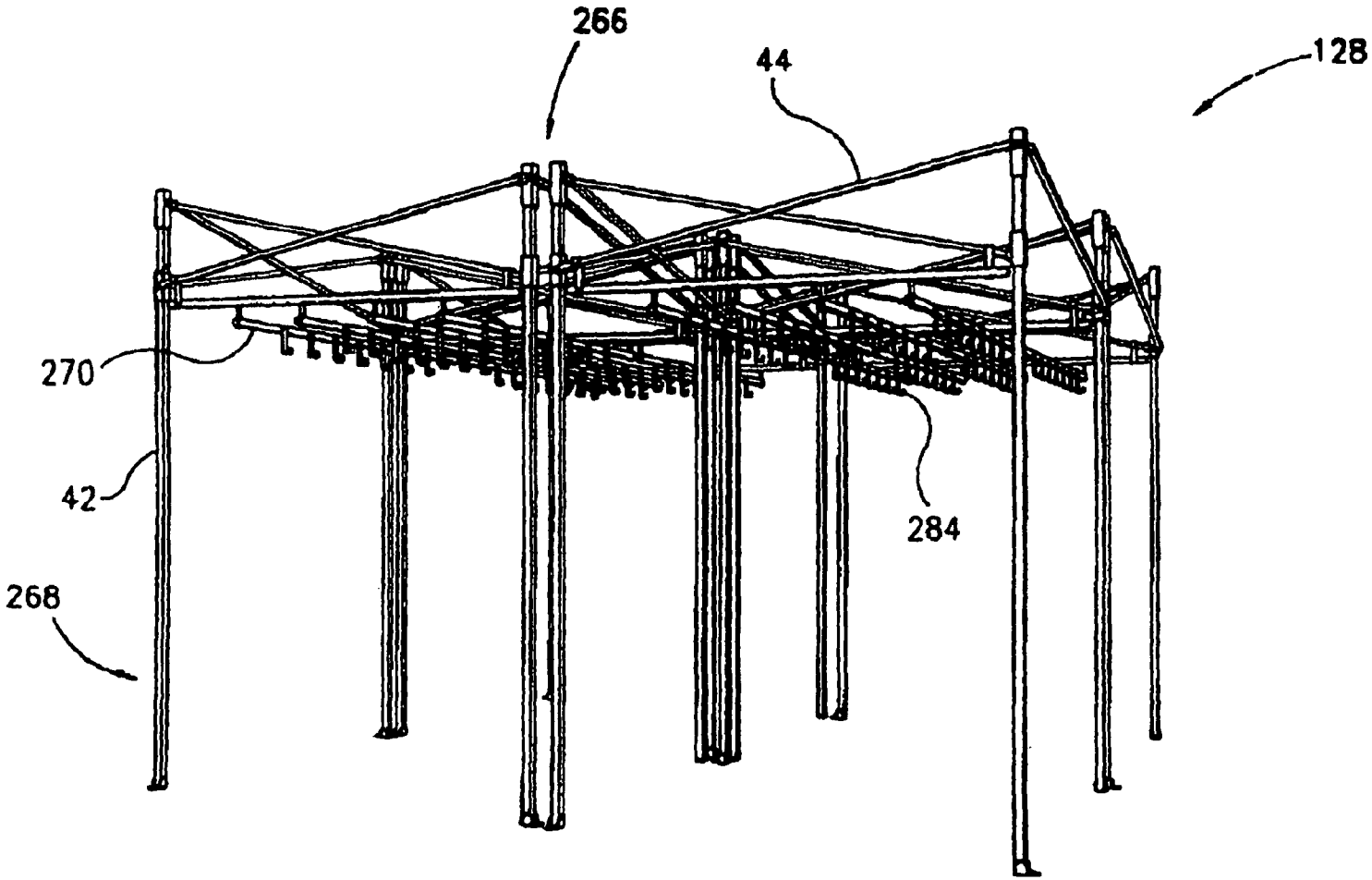
FIG. 29 is a front perspective of a plurality of station frames each having the hanger bar assembly of FIG. 26 and a plurality of doffing hooks removably attached to the hanger bar assemblies.

As illustrated in FIG. 1, the first station 120 also includes the external equipment removal area 128 positioned diagonally downstream of the wash and hold area 126. The personnel move from the wash and hold area 126 to the external equipment removal area 128 and begin to systematically remove equipment or gear that they may be carrying or wearing before they progress to the other decontamination stations. In one embodiment, the equipment and gear is systematically removed from the ground up. As best seen in FIG. 29, the equipment removal area 128 includes a plurality of doffing racks 266 adapted to removably retain equipment thereon. The doffing racks 266 include a collapsible station frame 268 having the same configuration as the station frame 130 discussed above. The station frame 268 is movable between a collapsed position shown in FIG. 30 to an expanded position shown in FIG. 31. When the station frame 268 is in the expanded position, a collapsible hanger assembly 270 hooks onto the station frame's scissoring cross members 44.

Figure 31:
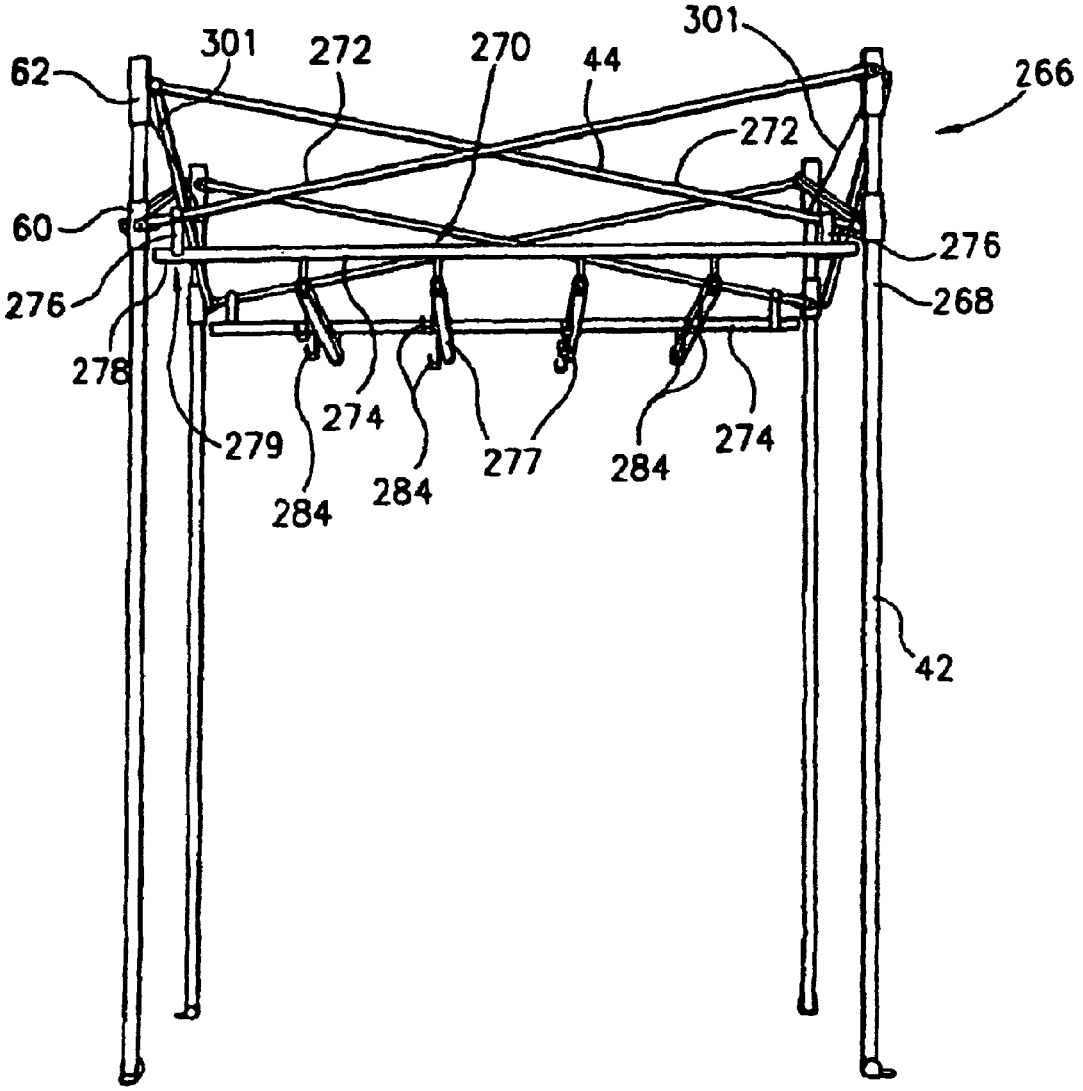
FIG. 31 is a front perspective view all of a station frame of FIG. 30 shown in an expanded position and a hanger bar assembly removably mounted to the station frame.

As best seen in FIG. 31, the hanger assembly 270 has a pair of elongated cross members 274 that hook onto the lower sections 272 of the scissoring cross members 44 with a pair of hooks 276. The hooks 276 are pivotally connected to the end portions of the cross members 274 and are oriented in opposing directions. This opposing orientation places the hooks 276 in proper position to engage spaced-apart lower sections 272 of the scissoring cross member 44, so the respective cross member is not skewed. The hooks 276 also allow the cross members 274 to be easily and quickly attached to the station frame 268. A plurality of hanger bars 277 are slidably attached to the bottom of the cross members 274.

Figure 32:
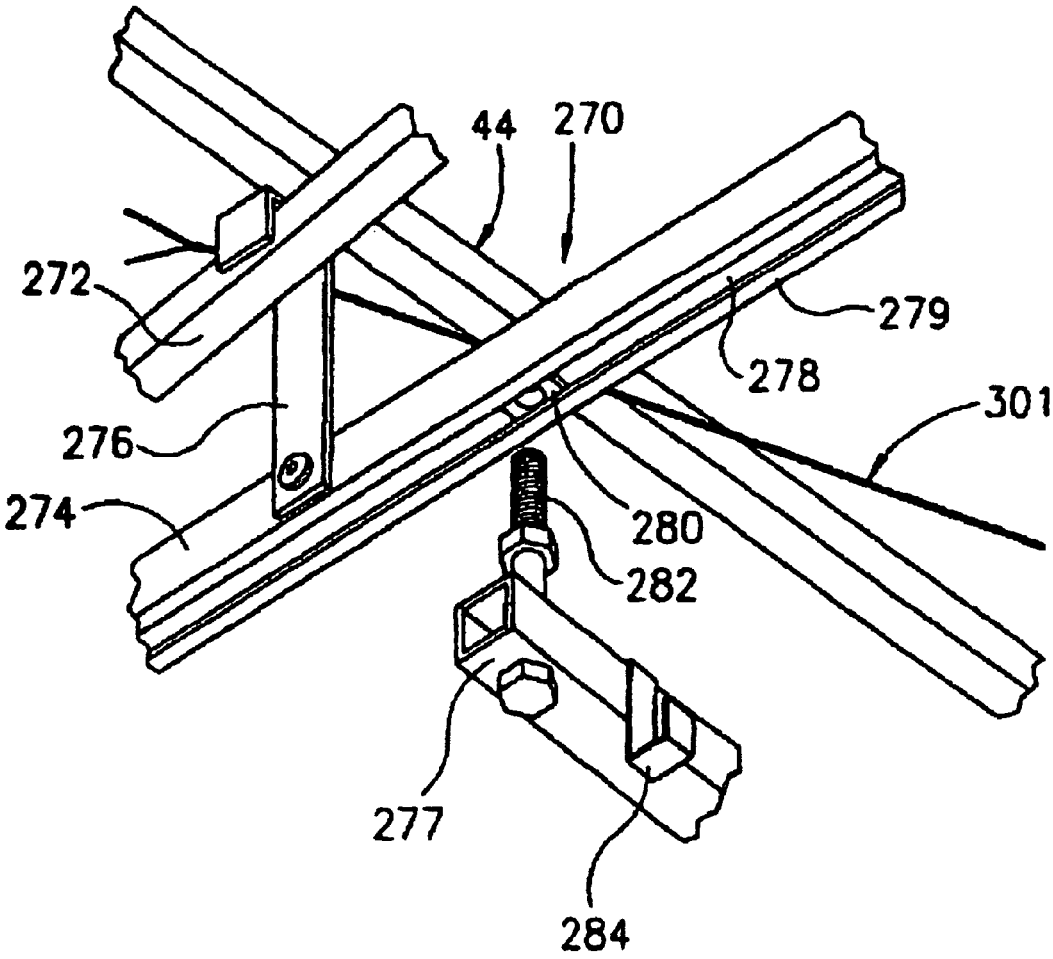
FIG. 32 is an enlarged partially exploded bottom isometric view showing a connection between a hanger bar and a slide rail of the hanger bar assembly of FIG. 31.

As best seen in FIG. 32, each cross member 274 has an elongated slot 278 formed in its bottom side 279, and a retention nut 280 is slidably captured within the slot. The retention nut 280 removably retains a connector 282 connected to the end of the respective hanger bar 277. In the illustrated embodiment, the connectors 282 are threaded bolts that screw into the respective retention nuts 280. The connectors 282 can be loosely attached to the retention nuts 280 so that the retention nuts can slide within slots to selectively move the hanger bars 277 along the cross member 274. The connectors 282 can also be tightened down against the respective retention nuts 280 so the hanger bars 277 are securely attached to the cross members 274 and temporarily not movable.

In the illustrated embodiment, the hanger bars 277 and the cross members 274 are lightweight, strong, fiberglass bars that can support relatively heavy external equipment. The hanger bars 277 removably receive a plurality of doffing hooks 284 adapted to hold the external equipment above the ground. The doffing hooks can also slide along the hanger bars 276 to allow the hanging equipment to be easily moved or adjusted as needed.

As best seen in FIG. 31, the station frame 268 also has a pair of thin stabilizing cables 301, each extending between two of the support legs 42, and connected to the upper bracketry 52 on the support legs. The stabilizing cable 301 is fairly taut when the station frame 268 is in the expanded position, and the cable helps prevent the station frame from being over expanded. The stabilizing cable 301 also provides a "clothesline" type structure on which lightweight items can be hung.

As best seen in FIG. 1, the equipment removal area 128 of the illustrated embodiment also includes a pair of wash tub assemblies 168 (discussed above) positioned so personnel can wash after hanging the equipment on the doffing hooks 284. The equipment removal area 128 is provided with one or more trash hamper assemblies 136 (discussed above) to receive and contain any trash, debris, or the like before the personnel progresses to the second station 290 of the decontamination and containment system 10.

Figure 33:
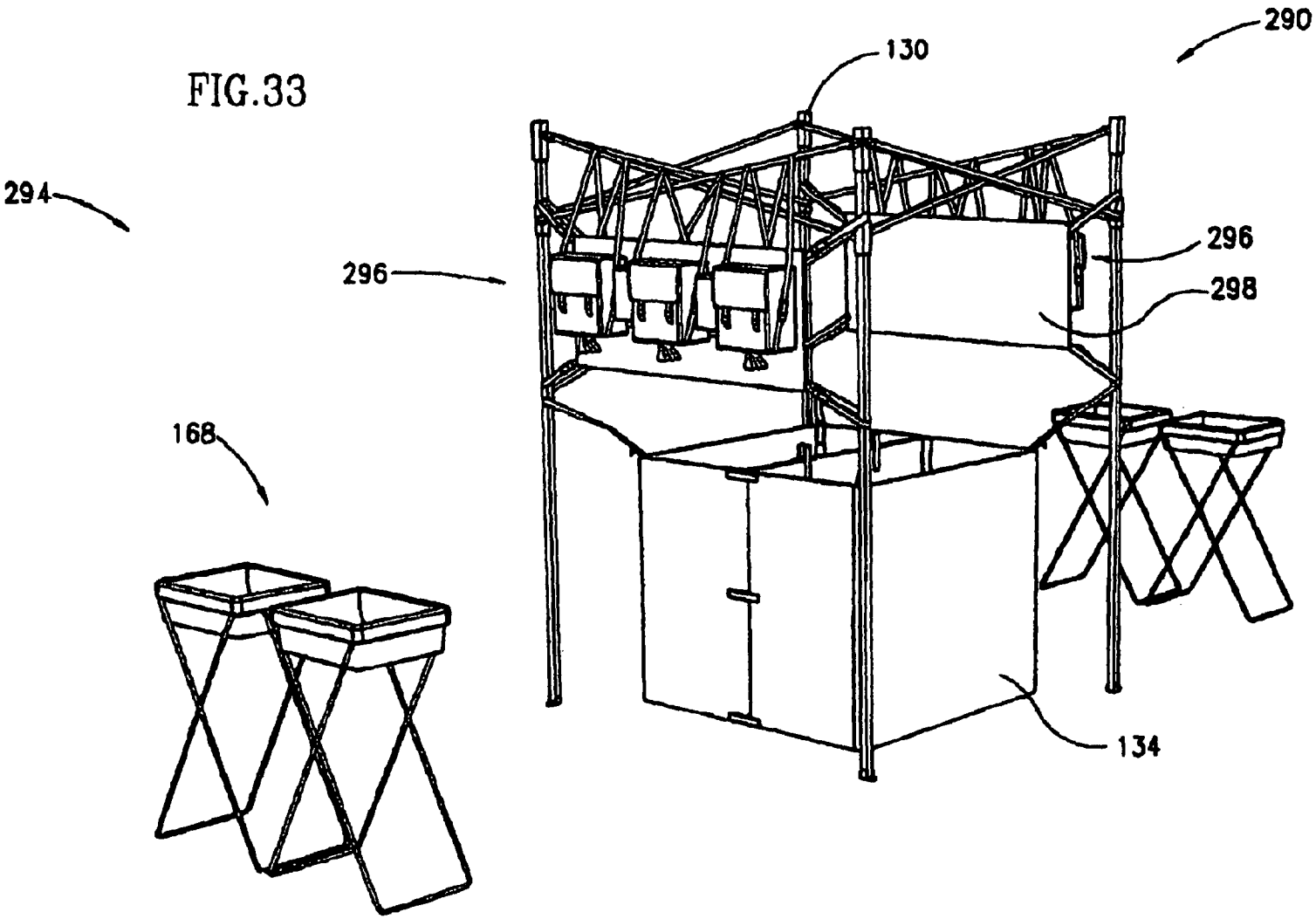
FIG. 33 is an enlarged isometric view of a second station of the decontamination and containment processing system of FIG. 1 showing a mask wipe and hood removal area that includes a tri-wipe assembly removably attached to the station frame.

The second station 290 of the illustrated embodiment includes a boot wash area 292 and a mask wipe and hood removal area 294. The boot wash station 292 includes a pair of shuffle box assemblies 170 positioned upstream from the mask wipe and hood removal area 294. Accordingly, personnel moving the into the second station 290 walk through one or more of the shuffle box assemblies 170 before progressing to the mask wipe and hood removal area 294. As best seen in FIG. 33, the mask wipe and hood removal area 294 includes a plurality of wash tub assemblies 168 adjacent to a station frame 130 that removably retains a dual hamper assembly 134 (discussed above) and positioned to receive hoods, hats, masks or other head gear removed from the personnel. In one embodiment, the mask wipe and hood removal area 294 includes a signage assembly 132 (as discussed above and shown in FIG. 17) to provide instructions and/or information about the mask wash and hard removal process.

The mask wipe and hood removal area 294 includes tri-wipe dispenser assemblies 296 releasably attached to the station frame 130. The tri-wipe dispenser assemblies 296 allow the personnel to easily and cleanly obtain selected towelettes to clean or neutralize the mask that the personnel may be wearing during the decontamination process. The towelettes could also be used to clean or wipe the personnel's head, neck, face, or the like.

Figure 34:
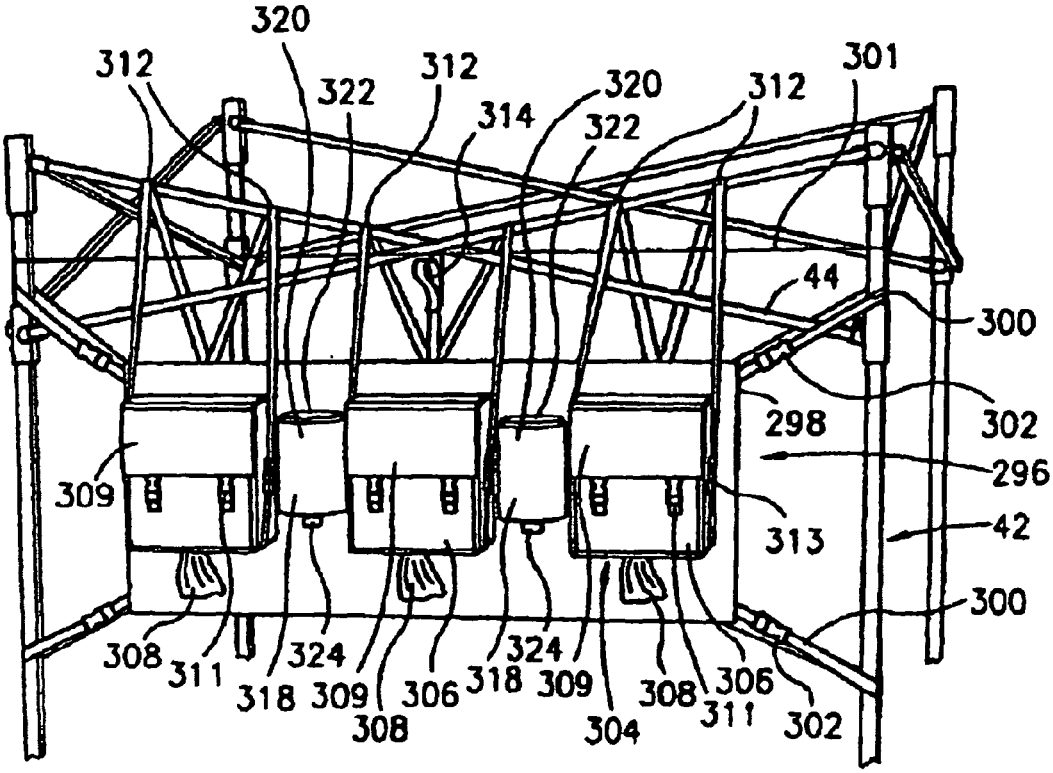
FIG. 34 is an enlarged front elevation view of the tri-wipe towelette dispenser assembly of FIG. 33.

As best seen in FIG. 34, each tri-wipe dispenser assembly 296 of the illustrated embodiment has an elongated, flexible base 298 with attachment straps 300 securely attached to the corners of the base 298. The attachment straps 300 securely retain the base 298 so it is substantially vertically oriented. The attachment straps 300 each include an adjustable quick clip 302 that allows the respective attachment strap to wrap around the respective support leg 42 of the station frame 130 and clip to itself. In the illustrated body, the upper attachment straps 300 extend around the support legs 42 at a position above a portion of the scissoring cross member 44, so the cross member prevents the dispenser assembly 296 from sliding or migrating down the support leg 42. The lower attachment straps 300 are each wrapped around a middle portion of the respective support leg 42 and tightened enough to stabilize the bottom of the base 298 and inhibit excess movement of the base 298, while not excessively pulling on the support leg 42.

Three towelette dispensers 304 are attached to the base 298 so the dispensers are sequentially aligned horizontally. The towelette dispensers 304 each have a container portion 306 that removably retains a plurality of towelettes 308 therein. A cover flap 309 is attached to each container portion 306 and positioned to cover an open top side of the container portion. In the illustrated embodiment, the cover flaps 309 are securely retained in a closed position by a pair of quick clips 311 attached to the container portion 306. Other embodiments can provide other cover configurations and retention devices for the towelette dispensers to prevent rain, debris, or other contaminants from getting into the container portion 306 and onto the towelettes 308.

Each towelette dispenser 304 is attached to a support strap 312 that extends up and over the scissoring cross member 44, connects to the back side of the base 298, and then connects to itself via a quick clip 313. The support strap 312 is adjustable at the quick clip 313 so as to provide vertical support to the container portion 306, particularly when a towelette 308 is removed. The adjustable support straps 312 also allow the positions or orientation of the container portions 306 to be manipulated if needed when the tri-wipe dispenser 296 is being set up on the station frame 130. In the illustrated embodiment, an anchoring strap 314 is attached to the back side of the base 298 and also removably attaches to the middle of the scissoring cross members 44. The anchoring strap 314 prevents the base 298 and the towelette dispensers 304 from sliding laterally on the station frame 130 during use. While the illustrated embodiment shows the use of straps and quick clips, other support devices and attachment mechanisms can be used in alternate embodiments to hold the base 298 and towelette dispensers 304 in a stable position on the station frame 130.

Figure 35:
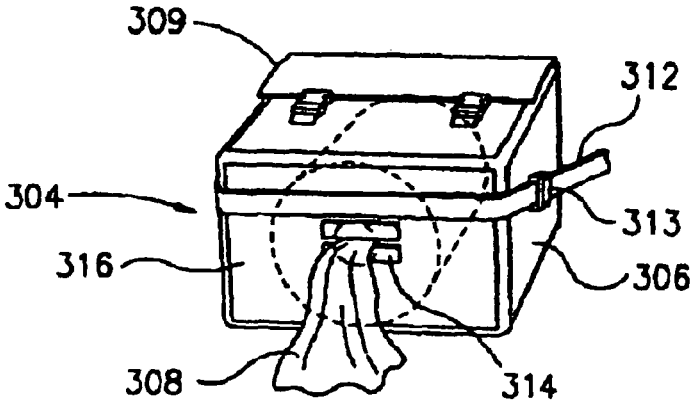
FIG. 35 is an enlarged bottom perspective view of a towelette dispenser of the tri-wipe towelette dispenser assembly of FIG. 34.

As best seen in FIG. 35, the towelette dispensers 304 contain a plurality of the towelettes 308 (shown in hidden lines in a roll form), so the towelettes can be dispensed one at a time through a slot 314 formed in the bottom side 316 of the container portion 306. In one embodiment, the towelettes 308 are releasably connected to each other in series so one towelette can be removed through the slot 314 and a portion of the next sequential towelette will be pulled partially through the slot into a position to be dispensed next. In the illustrated embodiment of FIGS. 33 and 34, each of the towelette dispensers 304 contain towelettes 308 with selected treatments thereon.

In one embodiment, the towelettes 308 in the first towelette dispenser 304 (shown on the left of FIG. 34) are saturated with a liquid neutralizing or decontaminating agent, such as bleach or ammonium chloride. The second, middle towelette dispenser contains towelettes 308 saturated with water, which mitigates any caustic effects of the neutralizing or decontaminating agent. The third towelette dispenser 304 contains dry towelettes 308 or towelettes coated with a drying agent. Accordingly, personnel progressing through the tri-wipe dispenser assembly can sequentially take and use the treated towelettes 308 as needed to decontaminate and neutralize the personnel's head and neck areas. Each of the towelettes is disposed of in a suitable trash hamper or the into the hamper assembly, thereby helping to contain the contaminants. In other embodiments, the towelettes 308 in the different towelette dispensers 304 can have different treatments, as suitable for the selected decontamination process.

In the illustrated embodiment of FIG. 34, the tri-wipe dispenser assembly 296 includes a pair of liquid/powder dispensing assemblies 318 attached to the base 298 between the towelette dispensers 304. The liquid/powder dispensing assemblies 318 include a substantially cylindrical sleeve or holster 320 attached to the base 298 and sized in shaped to receive a selected dispenser bottle 322 therein. The dispenser bottle 322 can be a powder dispenser bottle or a liquid spray bottle that contains a selected decontamination or neutralizing agent. The holster 320 has an aperture in its bottom through which the cap 324 of the dispenser bottle 322 extends. Accordingly, the dispenser bottle 322 is retained in an inverted position within the holster 320 for easy access to the agent therein.

The mask wipe and hood removal area 294, in one embodiment, can also include a fan assembly 410 (shown in FIG. 44 and discussed below) that provides a directed flow of air. The personnel can stand in the flow of air, for example, while removing his or her hood. The flow of air can help prevent contaminates from the hood from dropping onto the personnel's head and face during the hood removal process. The flow of air can also disburse any harmful vapors that could linger in the hood removal area or other area in other stations.

Figure 36:
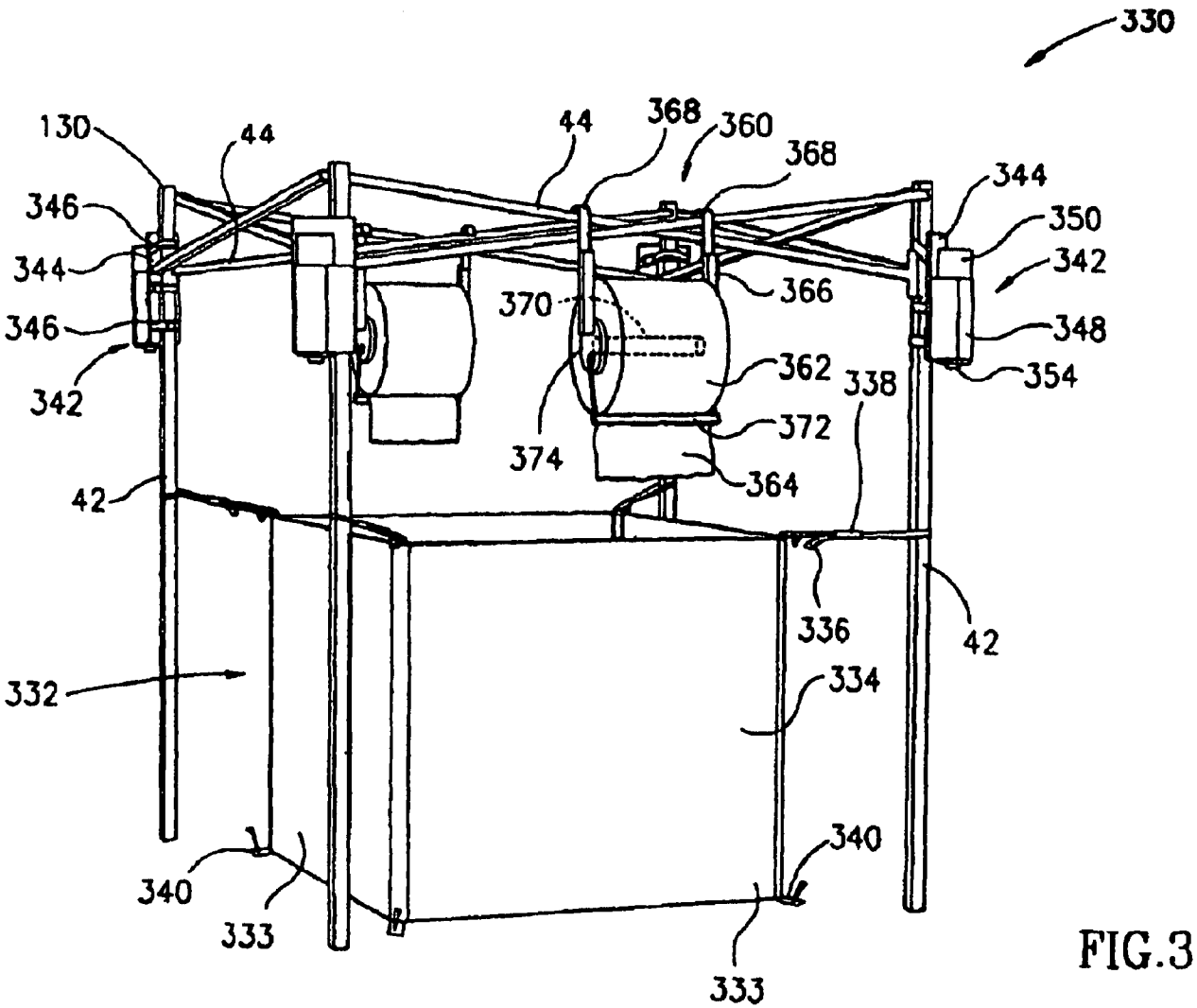
FIG. 36 is an enlarged front isometric view of an accessory station with a station frame of FIG. 24 in an expanded position and supporting a plurality of powder/liquid dispensers, a pollybag dispenser assembly and a hamper assembly.
Figure 37:
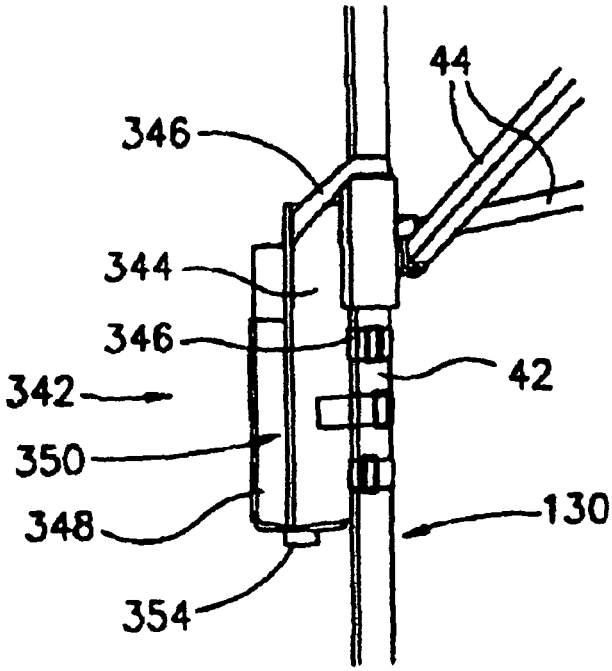
FIG. 37 is an enlarged rear isometric view of the powder/liquid dispenser of FIG. 36 shown releasably attached to the station frame.

In one embodiment, the decontamination and containment system 10 includes an accessory station 330 illustrated in FIG. 36. The accessory station 330 includes a station frame 130 with a contaminant hamper assembly 332 securely attached to the frame's support legs 42. The containment hamper assembly 332 includes a large collapsible hamper bag 334 that connects at its upper corners to the support legs 42 by attachment straps 336. The attachment straps 336 in the illustrated embodiment include quick clips 338 that allow the straps to connect themselves for easy and quick assembly and disassembly. The hamper bag 334 has a large opening shaped and sized to receive a large volume of clothing or other items, thereby containing the items and contaminates and preventing the contaminants from being spread further. The bottom corners 333 of the hamper bag 334 included tie-down loops 340 that allow the hamper bag to be secured to the ground by stakes, sandbags, or other suitable means.

Figure 30:
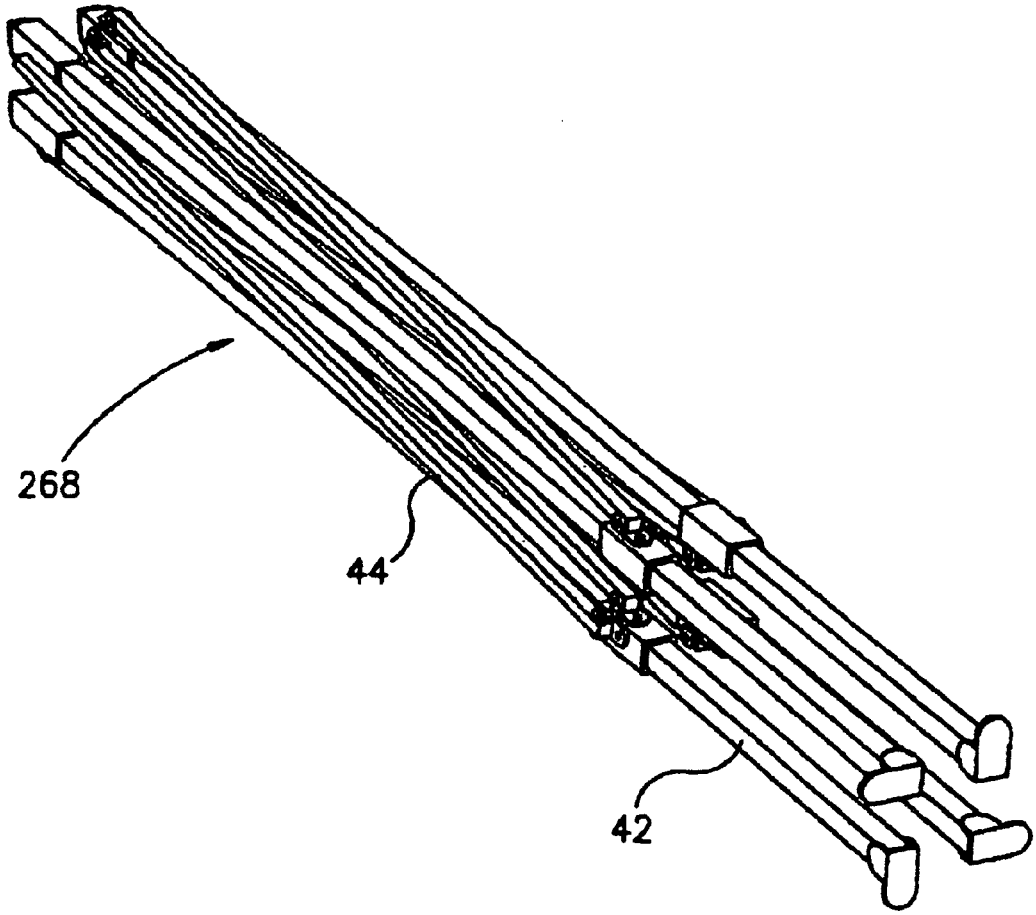
FIG. 30 is a front elevation view of a station frame of the decontamination and containment processing system of FIG. 1, the station frame being shown in a collapsed position.

The accessory station 330 also includes a plurality of powder/liquid dispenser assemblies 342 removably attached to the corners of the shelter frame 130. As best seen in FIGS. 30 and 32, powder/liquid dispenser assemblies 342 include a rigid back plate 344 with a plurality of releasable straps 346 that securely attach to the support legs 42 of the shelter frame 130. One of the straps 346 at the top of the back plate 344 is releasably connected to the respective support leg 42 at a position just above scissoring cross member 44. Accordingly, the scissoring cross member 44 prevents the liquid/powder dispenser assembly 342 from sliding down the support leg 42.

A substantially cylindrical retaining sleeve 348 is attached to the front side of the back plate 344 and is shaped and sized to removably retain a dispenser bottle 350. The bottom of the retaining sleeve 348 allows a cap 354 of the dispenser bottle 350 to extend therethrough. The dispenser bottle 350 is retained in an inverted position for easy and fast dispensing of the agent in the bottle.

Figure 38:
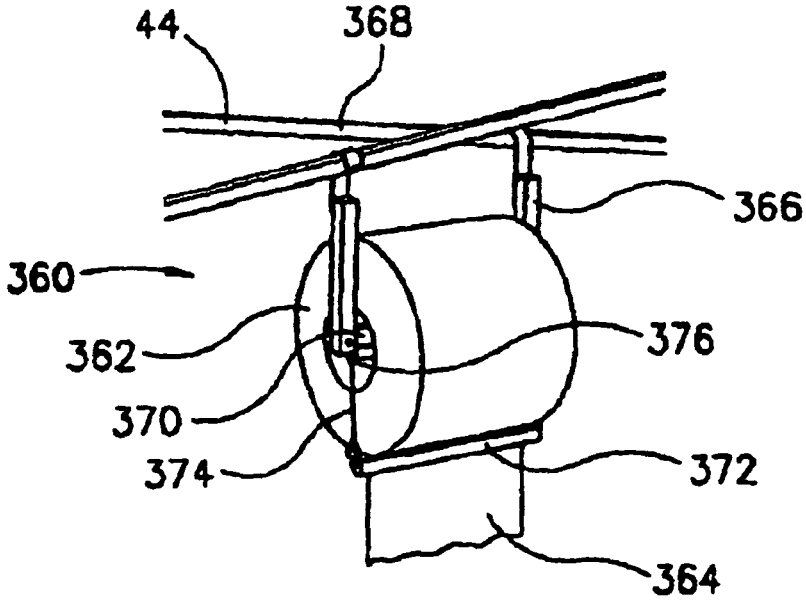
FIG. 38 is an enlarged front isometric view of the pollybag dispenser assembly of FIG. 36.
Figure 39:
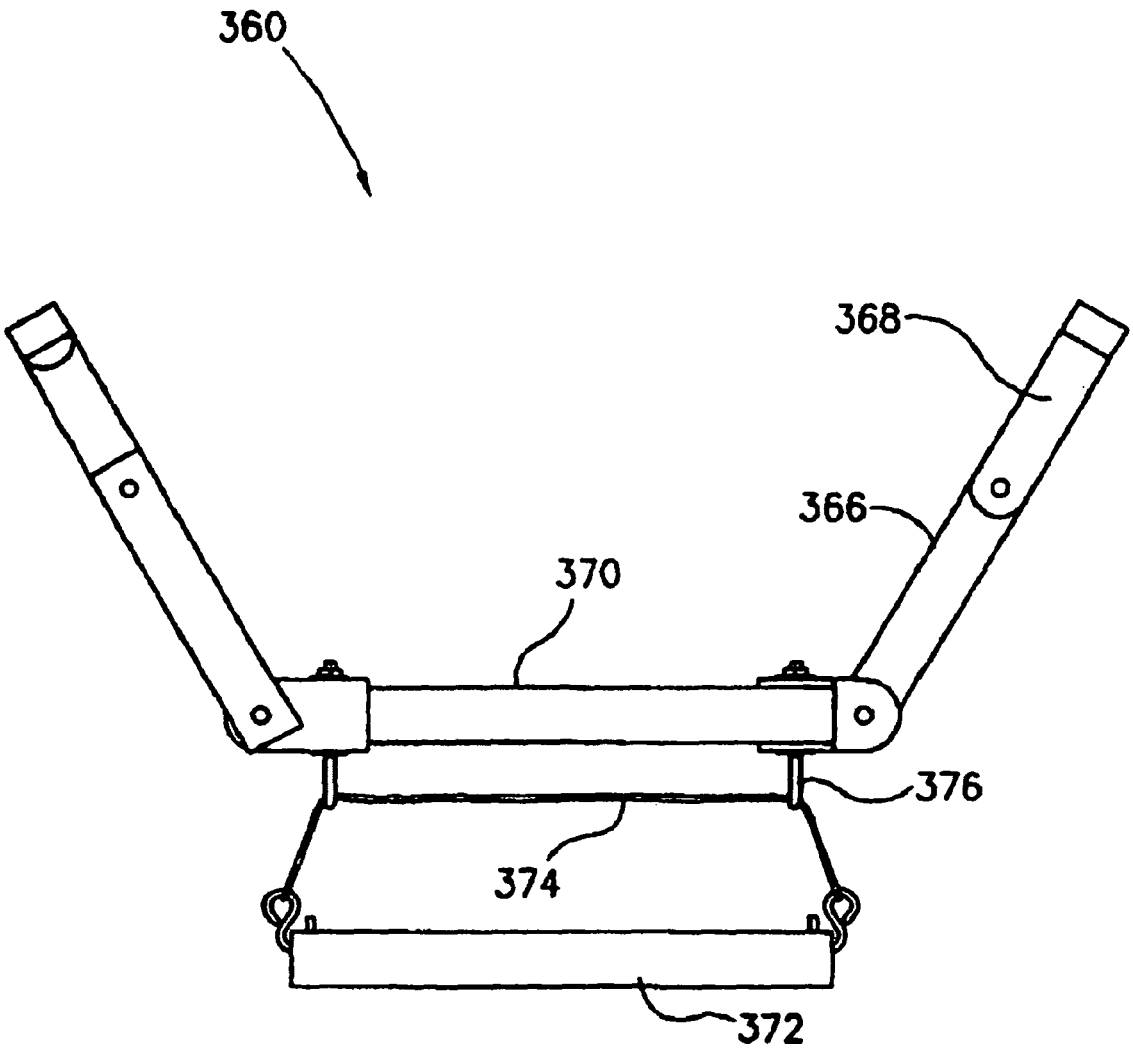
FIG. 39 is an enlarged front elevation view of the pollybag dispenser assembly frame of FIG. 38 with the roll of polybags not shown.

As best seen in FIGS. 36, 38 and 39, the accessory station 330 also includes a pollybag dispenser assembly 360 that releasably hooks onto the scissoring cross members 44 of the shelter frame 130. The pollybag dispenser assembly 360 retains a pollybag roll 362 of sequentially connected plastic tube socks 364 that can be used to temporarily cover personnel's hands and feet. The dispenser assembly 360 has a pair of spaced apart support legs 366 that removably connect to the scissoring cross member 44 with a pair of opposing attachment hooks 368. A support bar 370 is connected to the bottom end of the support legs 366 and extends through the pollybag roll 362. Accordingly, the pollybag roll 362 can move about support bar 322 as the plastic tube socks 364 are dispensed. The support bar 370 is also releasably connected to one or both of the support legs 366 to allow for easy installation or replacement of the pollybag roll 362. The poly-bag dispenser assembly 360 also includes a tear bar 372 securely held against the pollybag roll 362 in a positioned that allows the individual poly-bags 364 to be torn or separated from the next sequential bag on the roll. The tear bar 372 is held against the pollybag roll 362 by a tension member 374 releasably connected to the ends of the tear bar. In the illustrated embodiment, the tension member 374 extends from the tear bar ends, through eyelets 376 attached to the support bar 370, and through the pollybag roll 362 adjacent to the support bar. In an alternate embodiment, the eyelets or other guide members can be connected directly to the support legs 366. In the illustrated embodiment, the tension member 374 is an elongated rubber member with hooks on each end that hook onto the tear bar 372. The tension member 374 retains the tear bar 372 against the pollybag roll 362 as the bags are dispensed even as the roll gets smaller as all of the bags are dispensed. The tear bar 372 can be unhooked and released from the tension member 374 to allow for replacement of the pollybag roll 362. In alternate embodiments, different tension members can be used to maintain tension between the tear bar 372 and the poly-bags 364 as the poly-bags are dispensed from the roll 362. In one embodiment, this accessory station 330 is positioned at a location very early in the deployed system, so the personnel can place clean and sterile poly-bags over his or her hands and feet after any gloves and/or shoes have been removed. Covering the hands and feet with the poly-bags helps prevent cross-contamination and helps avoid contaminates from contacting the personnel's skin.

Figure 40:
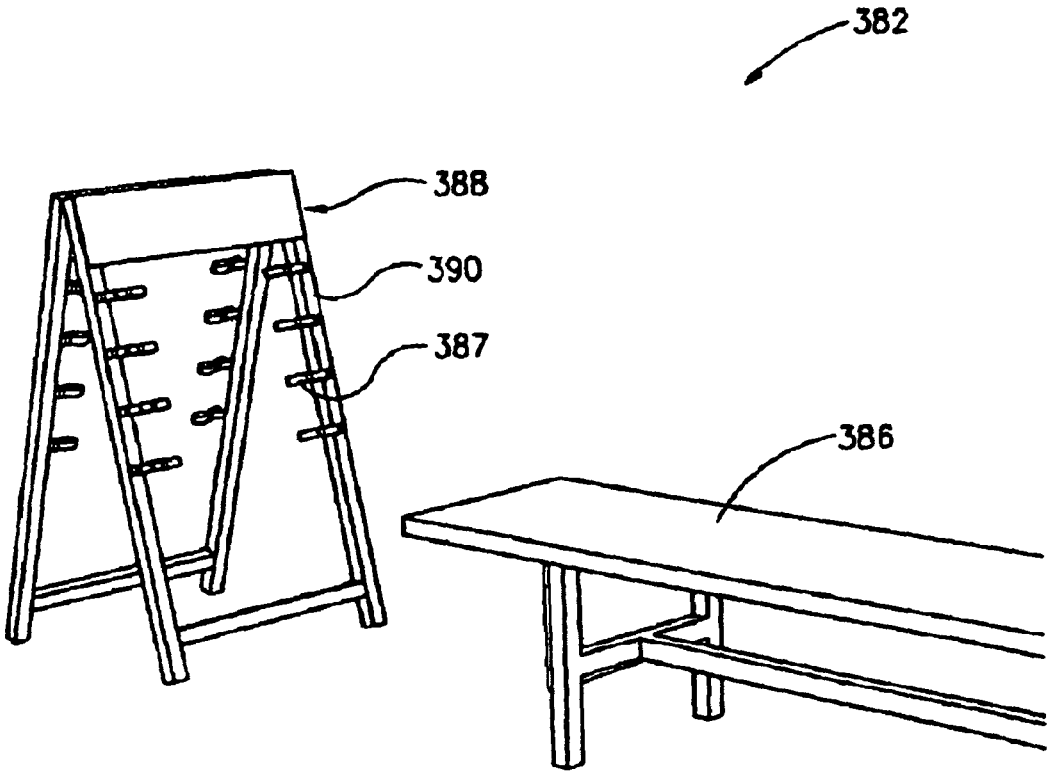
FIG. 40 is an enlarged isometric view of a third station of the decontamination and containment processing system of FIG. 1 showing a boot removal area with a collapsible bench and a garment stand.
Figure 41:
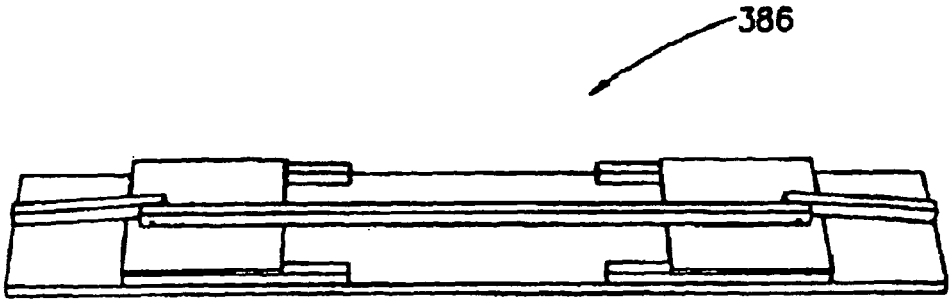
FIG. 41 is an enlarged bottom isometric view of the collapsible bench of FIG. 40, the bench being shown in a collapsed position.

Referring again to FIG. 1, the third station 380 of the decontamination and containment system 10 is downstream and diagonally adjacent to the second station 290. The third station 380 has a pair of signage assemblies 132 therein to provide instructions and directions to personnel entering the third station. The third station 380 also includes an overboot removal area 382 and an overgarment removal area 384. As best seen in FIGS. 1 and 40, the overboot removal area 382 includes a plurality of collapsible benches 386 adjacent to a pair of garment stands 388 and a pair of trash hamper's 136 (FIG. 1). The collapsible benches 386 and garment stands 388 are positioned to allow personnel to sit on a bench, and remove their footwear and secure the footwear on the garment stand. The collapsible bench 386 is movable between an extended position illustrated in FIG. 40 and a collapsed position illustrated in FIG. 41. In the collapsed position, the bench 386 is substantially flat so it requires a minimum amount of space when packed or stored.

As best seen in FIG. 40, the garment stand 388 in one embodiment has two pairs of support legs 390 connected to each other at their top ends and spaced apart from each other at their bottom ends so as to provide an A-frame type structure. A plurality of clips 387 are attached to each of the support legs 390 and positioned to removably retain boots, shoes, booties (poly-bags) or other foot coverings thereon above the ground after removal from the personnel. The clips 387 are attached to the respective support legs 390 by straps so that the clips remain fixed along the support leg even when supporting booties or the like. After one of the garment stands 388 is sufficiently full with footwear, the full garment stand can be picked up and relocated without having to touch the footwear again.

Figure 42:
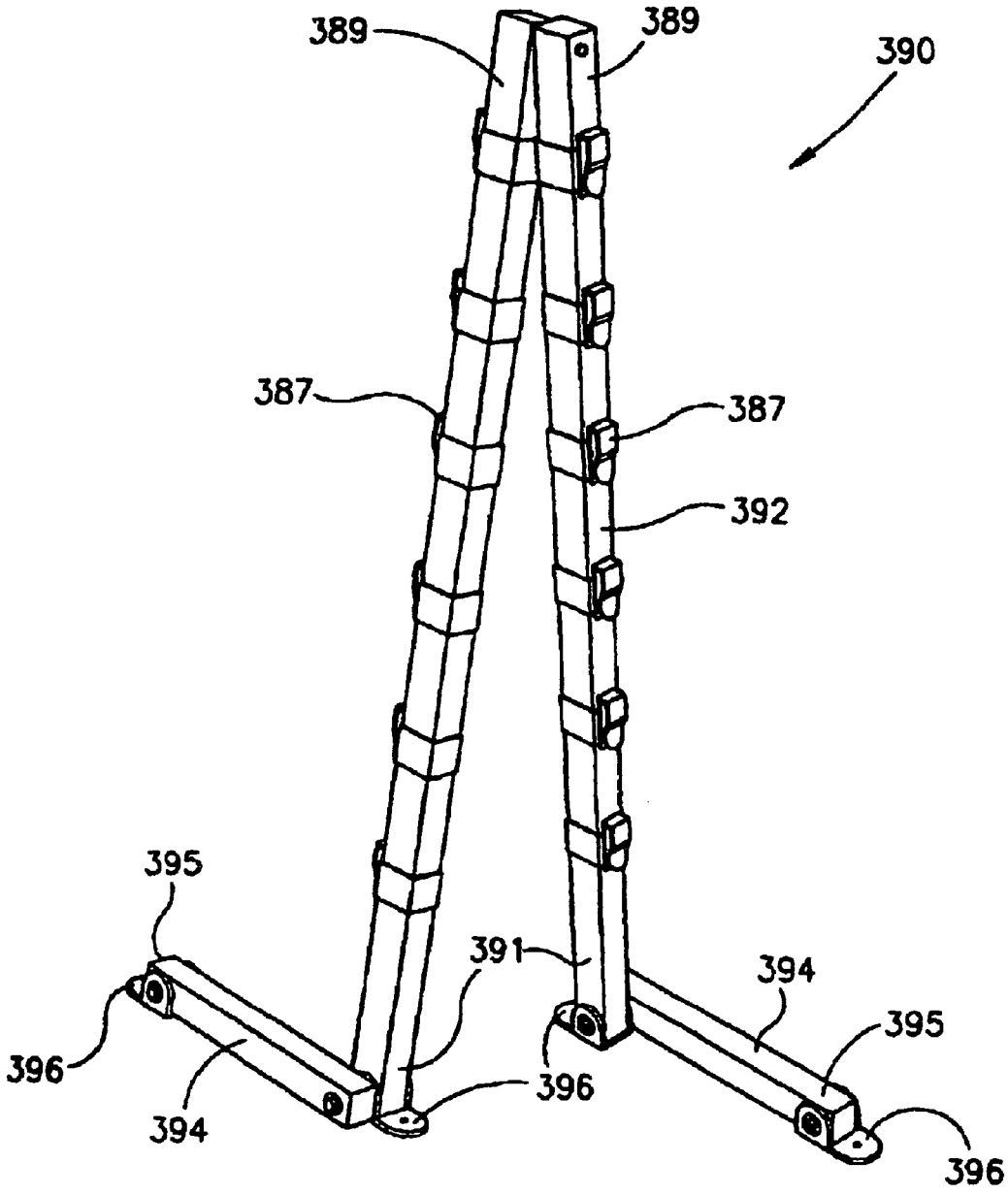
FIG. 42 is an enlarged isometric view of an alternate embodiment of the garment stand of FIG. 40.

In an alternate embodiment illustrated in FIG. 42, a garment stand 390 has one pair of support legs 392 pivotally connected to each other at their top ends 389, and the bottom ends 391 are spaced apart from each other when the garment stand is expanded. The bottom end 391 of each support leg 392 is pivotally connected to a stabilizing leg 394. The stabilizing legs 394 extends away from the respective support legs 392 in opposite directions. The bottom end 391 of each support leg 392 and the free ends 395 of each stabilizing leg 394 have tie down clips 396 used to hold the garment stand on the ground in the upright position.

In this alternate embodiment, the garment stand 390 is collapsible to a very flat, stored position by pivoting the stabilizing legs 394 adjacent to the support legs 392 and pivoting the support legs adjacent to each other along their lengths. The clips 387 are positioned so they do not interfere with the support legs 392 when collapsing the garment stand 390 to the stored position.

Figure 43:
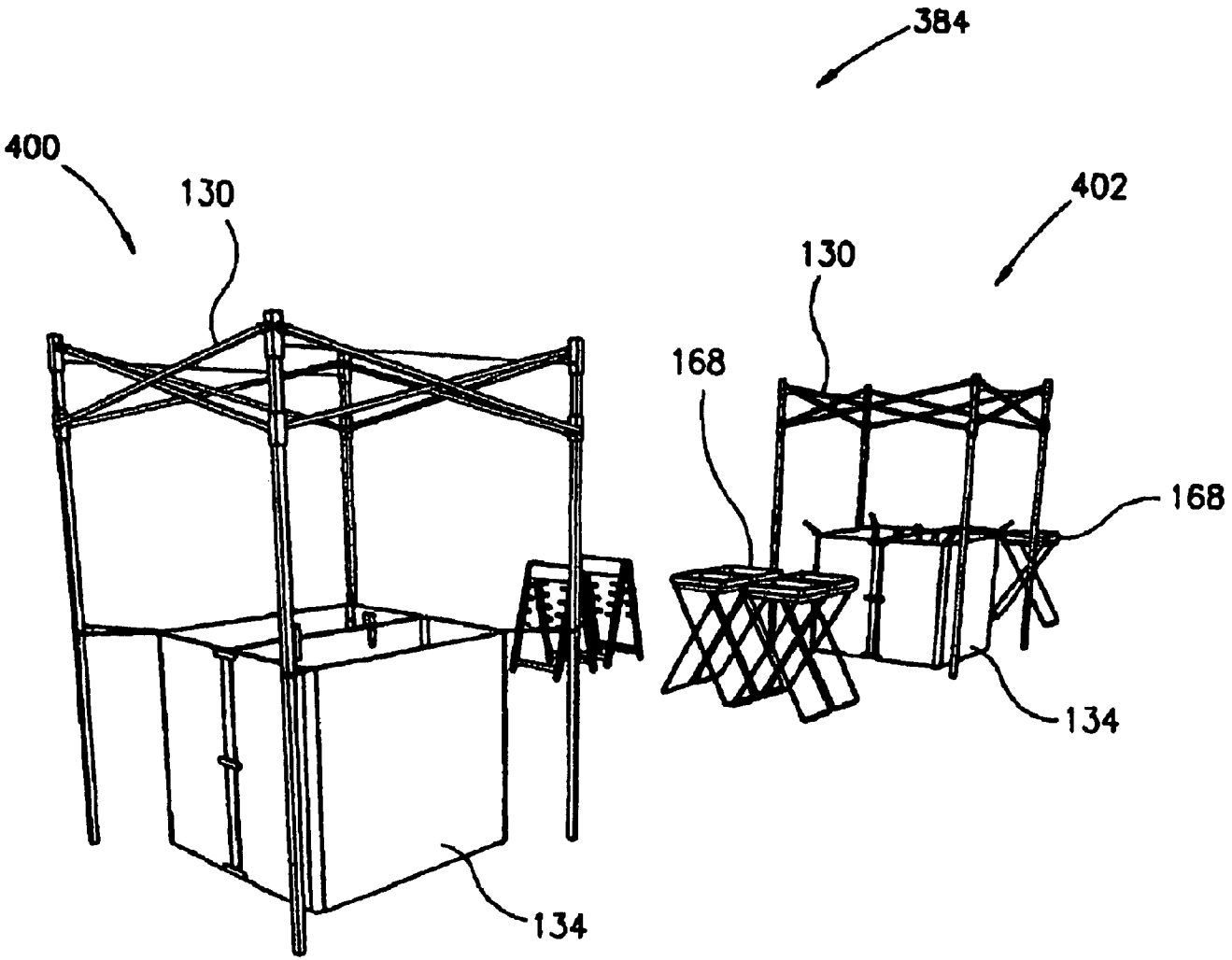
FIG. 43 is an enlarged isometric view a jacket and pants removal area in a third station of the decontamination and containment processing system of FIG. 1.

The overgarment removal area 384 includes a jacket removal area 400 and pants removal area 402 each positioned downstream from the overboot removal area 382. As best seen in FIGS. 1 and 43, the jacket and pants removal areas 400 and 402 each include a station frame 130 with dual hamper assemblies 134 connected thereto to receive and contain jackets, pants, and other overgarments removed by or from the personnel. The jacket and pants removal areas 400 and 402 each also includes a plurality of wash tub assemblies 168 positioned to allow the personnel to wash his or her hands and arms after removal of their jackets, pants or other outer garments. In the illustrated embodiment, the jacket and pants removal areas 400 and 402 each also include a pair of garment stands 388 positioned to allow the personnel to clip selected components of his or her outerwear onto the stands as needed rather than placing them into the hampers. In an alternate embodiment, the jacket and pants removal areas 400 and 402 also include signage assemblies 132 mounted on top of the station frames 130 to provide instructions or information about the removal process.

Figure 44:
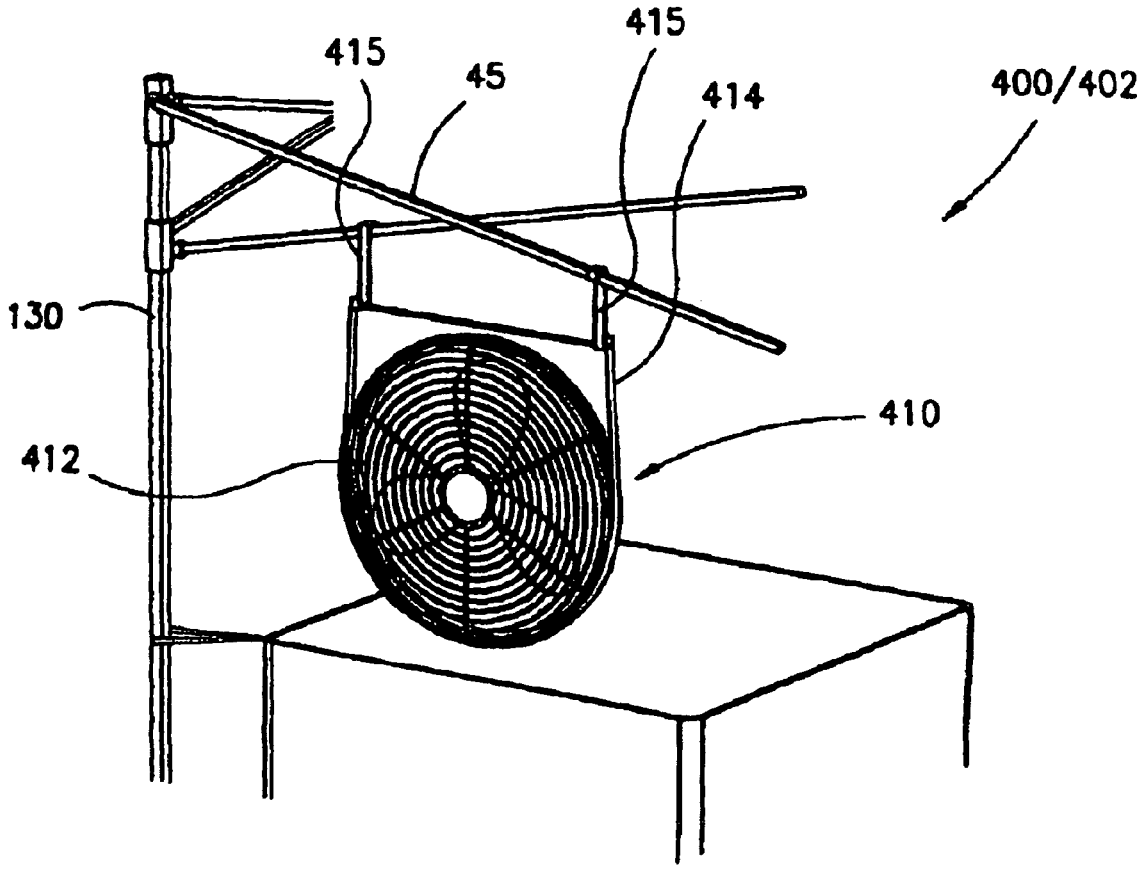
FIG. 44 is a front isometric view of a fan assembly removably attached to a station frame of the jacket and pants removal area of FIG. 43.

In one embodiment illustrated FIG. 44, the jacket and pants removal areas 400 and 402 includes a fan assembly 410 attached to the station frame 130 and positioned to direct air toward the personnel as he or she is removing outer garments. The fan assembly 410 is attachable to a power generator (not shown) with a conventional power cord. The fan assembly 410 has a caged fan 412 with a flexible strap 414 attached to the fan's cage 416. The strap 414 hooks onto a pair of doffing hooks 415 that removably attach to the scissoring cross members 44 on opposing sides of the cross members pivot point 45. Accordingly, the fan assembly 410 can be quickly and easily installed on the selected station frame 130. While the fan assembly 410 is shown and described with the jacket and pants removal areas 400 and 402, the fan assembly 410 can be used at other stations as desired to facilitate the selected decontamination and containment process.

Figure 45:
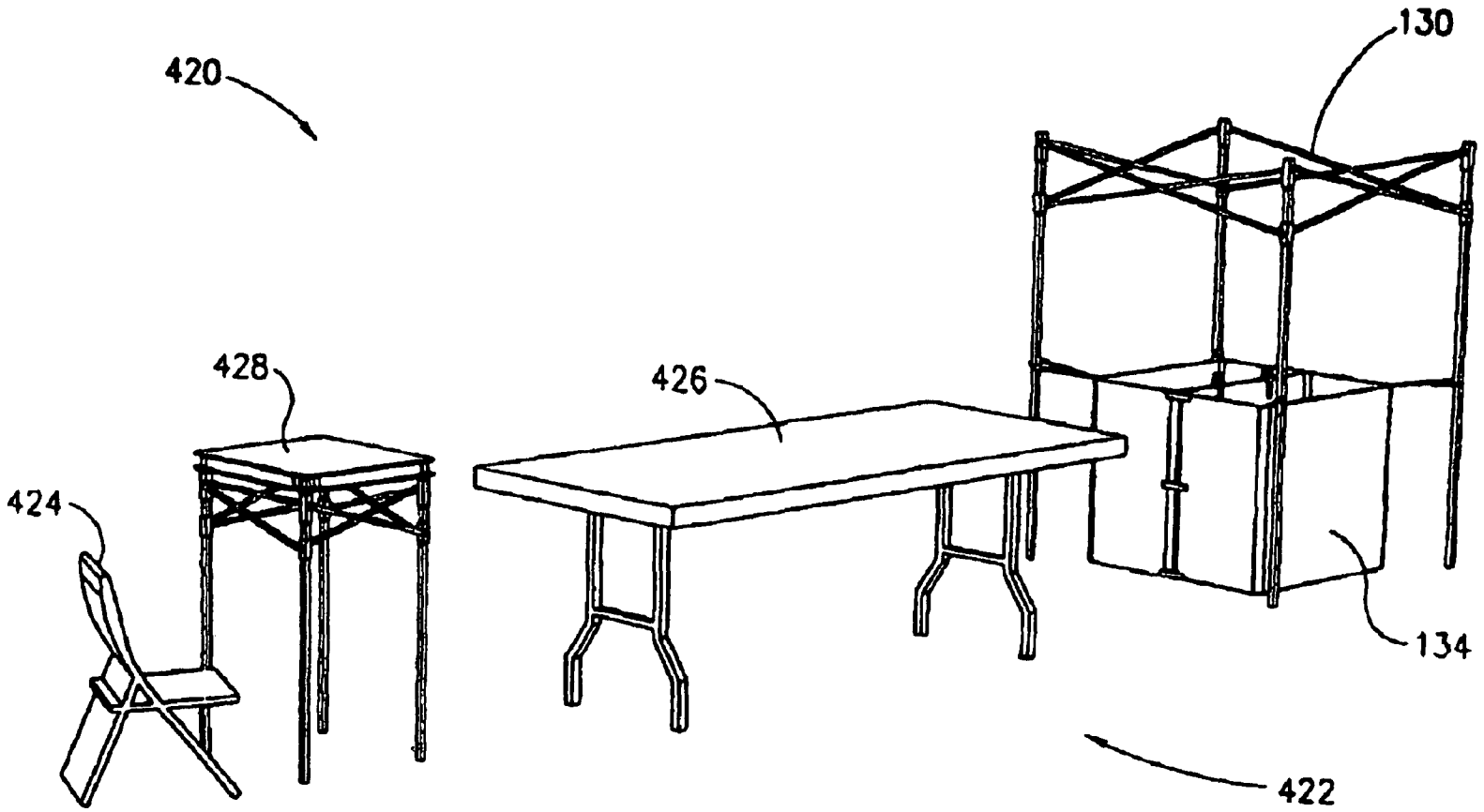
FIG. 45 is an enlarged front isometric view of a fourth station of the decontamination and containment processing system of FIG. 1 showing a mask monitoring and undergarment removal area.

The fourth station 420 of the decontamination and containment system 10, as shown in FIG. 1, is positioned diagonally adjacent and downstream from the third station 380. The fourth station 410 provides a monitoring and removal area 422 for mask monitoring, glove removal, and undergarment removal. As best seen in FIG. 45, the removal and monitoring area 422 includes a station frame 130 with a hamper assembly 134 attached to it to receive the personnel's gloves and undergarments. The removal and monitoring area 422 in one embodiment also includes wash tub assemblies 168 to allow the personnel to wash or neutralize his or her hands and arms after removing gloves, undergarments, or the like. The fourth station 410 includes a signage assembly 132 to provide instructions and directions to personnel entering the station.

The removal and monitoring area 422 of the illustrated embodiment also includes collapsible chairs 424, a collapsible table 426, and a collapsible stand 428 similar to the collapsible stand 172 of the weapons clearing assembly 166 discussed above. The chairs 424, table 426, and stand 428 are set up to allow a personnel's mask worn during the decontamination and containment process to be inspected and adjusted or replaced as needed. If a mask is to be replaced, the mask can be removed from the personnel and disposed of in the hamper assembly 134. In alternate embodiments, trash hampers 136, garment stands 388, collapsible benches 386, wash tub assemblies 168, fan assemblies 410, or other components of the system 10 can be used for the selected decontamination and containment process. The fourth station 420 of the decontamination and containment system 10, as shown in FIG. 1, exits to the toxic free area (TFA).

Figure 46:
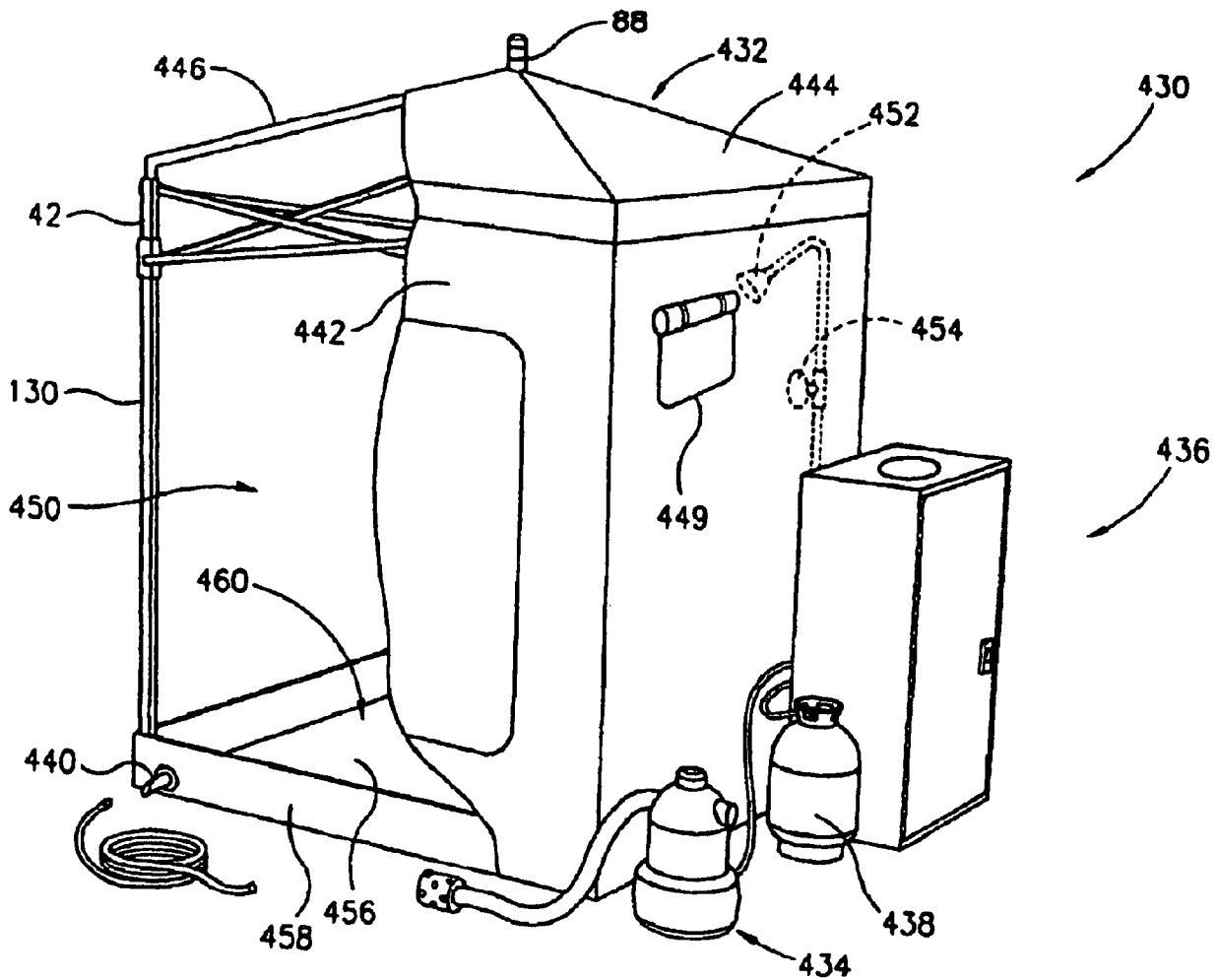
FIG. 46 is a partially cutaway enlarged isometric view of a shower and hot water delivery system in another station of the decontamination and containment processing system of FIG. 1.

The decontamination and containment system 10 of one embodiment also includes a shower and hot water delivery system 430 positioned diagonally adjacent and downstream of the removal and monitoring area 422. As best seen in FIG. 46, the system 430 includes a shower assembly 432, a water pump 434 connected to the shower assembly, and a water heater assembly 436 connected to the water pump to deliver hot water to the shower assembly. A fuel source 438 is connected to the water heater assembly 436 to heat the water on demand for delivery of hot water to the shower assembly 432.

The shower assembly 432 includes a shelter frame 130 with a roof frame 446 mounted to the top of the vertical support legs 42. Flexible wall coverings 442 are removably attached to the shelter frame 130 and a flexible one-piece ceiling 444 is removably attached to the roof frame 446 to form an enclosed shower area 450. The flexible wall coverings 442 include an entry doorway 448 and can include a vent window 449 as desired. The top of the shelter frame 132 includes a vent cap 88 attached to a roof frame 446 to provide ventilation through the top of the shower assembly 432.

The shower assembly 432 also includes adjustable shower head 452 coupled to the hot water pump 434 and the water heater assembly 436 with conventional water lines that can be easily and quickly assembled and disassembled without requiring tools. The shower head 452 has an on/off valve 454 that can be controlled with only one hand to turn the hot water flow on or off. Accordingly, personnel can enter the shower assembly 432 and activate the on/off valve 454 to direct hot water on demand through the shower head 452 in order to take a shower as one of the final decontamination steps.

The shower assembly 432 also includes a durable flooring 456 with raised sidewalls 458 to form a gray water containment area 460. The shower assembly also includes a gray-water drain assembly 440 connected to the raised sidewalls 458 and in communication with the gray water containment area 460. The drain assembly 440 is adapted to connect to a standard water hose 442 to direct gray water from the shower assembly to a suitable drain area. The flooring 456 contains the gray water generated during the shower process until the gray water can be drained from the shower assembly to a suitable water collection container or the like so the gray water can be disposed of in a selected and safe manner.

Each component of the shower assembly 432 is configured so it can be assembled and disassembled quickly and easily by hand without requiring tools. The interconnection between all of the other components of the shower and hot water delivery assembly 430 can also be accomplished without requiring additional tools so as to allow for easy and quick assembly and disassembly.

Figure 47:
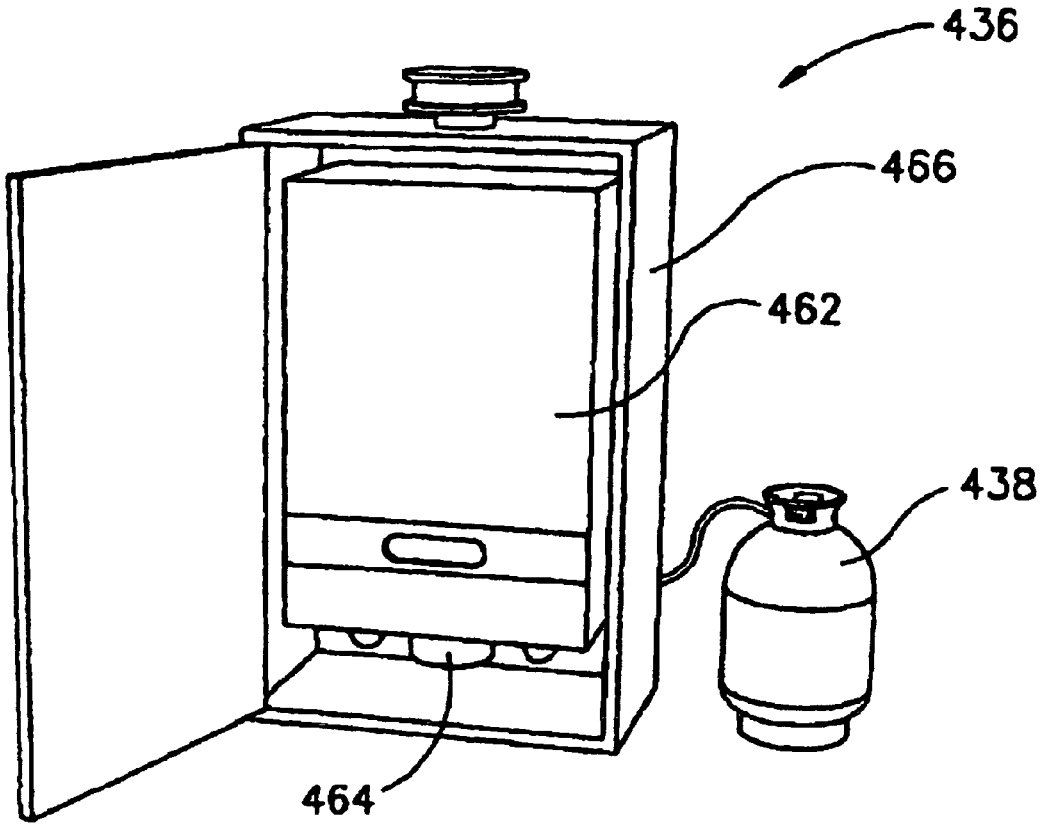
FIG. 47 is an enlarged isometric view of a water heater assembly of the shower and hot water delivery system of FIG. 46.

In the illustrated embodiment of FIG. 47, the water heater assembly 436 includes a water tank 462 with a burner assembly 464 coupled to the fuel source of 438, and positioned to burn the fuel below the water tank thereby heating the water within the water tank. In the illustrated embodiment, the fuel source 438 is a propane tank coupled to the burner assembly 464 with conventional fuel lines that can be connected and disconnected by hand. The water tank 462 and burner assembly 464 are contained within an outer housing 466 to protect the water tank and burner assembly from, as an example, rain or other environmental conditions.

Although specific embodiments of, and examples for, the present invention are described herein for illustrative purposes, various equivalent modifications can be made without departing from the spirit and scope of the invention, as will be recognized by those skilled in the relevant art. The teachings provided herein of the present invention can be applied to a decontamination and containment system for a wide variety of chemical or biological scenarios that may be encountered by personnel, and the system's components may be arranged on a decontamination area to form the number of stations needed to accomplish the decontamination and containment process. Thus, the system is not necessarily the exemplary stations and configurations generally described above.

These and other changes can be made to the invention in light of the above-detailed description. In general, in the following claims, the terms used should not be construed to limit the invention to the specific embodiments disclosed in the specification and the claims, but should be construed to include all systems and components that operate in accordance with the claims to provide a decontamination and containment system and method. Accordingly, the invention is not limited by the disclosure, but instead its scope is to be determined entirely by the following claims.

What is claimed is:

1. A systematic decontamination and containment method for decontaminating personnel, the method comprising:

providing a multi-component decontamination and containment system in a transportable container to a selected location;

deploying the decontamination and containment system on the selected location and forming a series of sequential decontamination stations;

receiving contaminated or potentially contaminated personnel at a first station;

providing visible information to the personnel relating to the decontamination process at one of the stations, the visible information being provided on a signage assembly;

moving the personnel to a plurality of separate selected stations for removal from the personnel one or more of headwear, footwear, hand coverings, and articles of clothing;

removing from the personnel at least one of the footwear and hand coverings;

dispensing plastic coverings shaped and sized to cover at least one of the feet and hands of the personnel;

applying the plastic coverings onto at least one of the feet and hands of the personnel after removal of at least one of the footwear and hand coverings from the feet and hands;

removing one or more of the articles of clothing from the personnel;

collecting one or more of the removed articles of clothing in a collapsible hamper assembly; and providing a plurality of disposable towelettes from a dispenser assembly.

2. The method of claim 1 wherein the providing visible information to the personnel on a signage assembly further comprises releasably mounting a signage having the visible information on a frame assembly.

3. The method of claim 1, further comprising evaluating contamination levels of the personnel.

4. The method of claim 1, further comprising providing a shuffle box assembly being positioned to allow the contaminated personnel to step therein, the shuffle box assembly containing a selected one of a dusting agent, a neutralizing agent, and a decontamination agent.

5. The method of claim 1 wherein removing the clothing from the personnel further comprises removing the clothing from the personnel after application of the plastic coverings.

6. The method of claim 1 wherein collecting one or more of the removed articles of clothing further comprises collecting one or more of the removed articles of clothing on one of a hanger assembly and a stand in such manner that the clothing is elevated above ground.

7. The method of claim 1 wherein providing a plurality of disposable towelettes from a dispenser assembly further comprises at least one of the towelettes being moistened with one of a neutralizing agent and a decontamination agent.

8. The method of claim 1, further comprising providing in one of the stations a fan assembly that moves an airflow therefrom, and positioning personnel in the air flow as the headwear is removed.

9. The method of claim 1, further comprising providing a shower assembly having a shower portion, a water supply source, and a gray-water collection area, and directing the personnel to the shower assembly.

10. The method of claim 1, further comprising providing a weapons clearing assembly comprising a container portion structured to receive and stop a projectile discharged from a weapon.

11. The method of claim 10, further comprising causing one or more projectiles to be discharged from a weapon into the container portion of the weapons clearing assembly.

12. A systematic decontamination and containment method for decontaminating personnel, the method comprising:

providing a decontamination and containment system deployable from a transport container to a selected location for forming a series of sequential decontamination stations;

on a signage assembly deployable adjacent to one of the stations, providing visual information relating to the decontamination process;

providing a plurality of separate selected stations for systematic removal of one or more of headwear, outer garments, footwear, hand coverings, and undergarments;

providing disposable coverings shaped and sized to cover the feet and hands of the personnel;

providing collapsible apparatus for collecting articles of clothing removed from the personnel in a position separated from a ground surface; and providing a plurality of disposable towelettes, one or more of the towelettes including one of a neutralizing agent and a decontamination agent.

13. The method of claim 12, further comprising providing a shower assembly having a shower portion, a water supply source, and a gray-water collection area.

14. The method of claim 12 wherein providing a decontamination and containment system further comprises providing a plurality of the decontamination stations in a collapsed condition and being deployable at the selected location.

15. The method of claim 14 wherein providing a decontamination and containment system further comprises deploying the plurality of the stations at the selected location.

16. The method of claim 15, further comprising receiving one or more of contaminated and potentially contaminated personnel at a first station.

17. The method of claim 16, further comprising collecting from one or more of the received personnel one or more external equipment carried by the personnel, and hanging the collected external equipment above ground level on a hanging assembly.

18. The method of claim 17, further comprising removing one or more of footwear and hand coverings from respective feet and hands of one or more of the received personnel.

19. The method of claim 18, further comprising removing articles of clothing from one or more of the personnel in a manner to avoid contaminants on the clothing from contacting the skin of the personnel.

20. The method of claim 19 wherein providing a plurality of disposable towelettes further comprises providing one or more towelette dispensers.

21. The method of claim 18, further comprising providing adjacent to one of the stations a fan structured for moving an airflow therefrom, and positioning personnel in the air flow as the headwear is removed.

22. The method of claim 12 wherein the providing visual information relating to the decontamination process on a signage assembly deployable adjacent to one of the stations further comprises providing a sign having the visual information provided thereon, and providing a frame assembly for releasably mounting the sign thereto.

23. The method of claim 12, further comprising providing a shuffle box assembly structured for containing therein a selected one of a dusting agent, a neutralizing agent, and a decontamination agent, the shuffle box assembly being positionable relative to one of the decontamination stations.

24. The method of claim 12 wherein providing collapsible apparatus for collecting articles of clothing separated from a ground surface further comprises providing one or more of a collapsible hamper assembly, a collapsible hanger assembly, or a collapsible garment stand.

25. The method of claim 12, further comprising providing a wash tub assembly having a tub portion structured for containing one of a dusting agent, a decontamination agent, and a neutralizing agent.

26. The method of claim 12, further comprising providing adjacent to one of the stations a fan structured for moving an airflow therefrom, the fan being positionable relative to one of the decontamination stations.

27. The method of claim 12, further comprising providing a container structured to receive and stop a projectile discharged from a weapon.

28. A systematic decontamination and containment method for decontaminating personnel, the method comprising:

providing a plurality of collapsible shelter assemblies movable between a free-standing deployed position and a collapsed position, and further comprising providing with each shelter assembly one or more supports having a collapsed position and a deployed position, wherein the one or more supports is in the collapsed position when the shelter assembly is in the collapsed position and being deployable in the deployed position when the shelter assembly is in the deployed position, and wherein one or more of the shelter assemblies is structured for forming at least a partially enclosed area in the deployed position;

providing a weapons clearing assembly, comprising providing a container portion defining an interior area and having an inlet area communicating with the interior area and sized to receive a portion of a selected firearm, a ballistic absorption material removably contained in the interior area and positioned relative to the inlet area to receive a discharged projectile thereinto;

providing a signage assembly positionable proximate to at least one of the shelter assemblies;

providing a collapsible containment hamper assembly positionable proximate to at least one of the shelter assemblies, wherein the containment hamper assembly is deployable from a collapsed position to a deployed position, and at least in the deployed position the hamper assembly further comprising an opening to receive items thereinto;

providing a towelette dispenser comprising at least one dispenser compartment sized to receive a set of towelettes shaped and sized to fit within the dispenser compartment, and a dispenser aperture being shaped and sized to allow towelettes from the set of towelettes to be dispensed therethrough; and providing a transportable containment enclosure shaped and sized to carry the shelter assemblies, weapons clearing assembly, signage assembly, containment hamper assembly, and towelette dispenser, and being transportable to a selected location.

29. The method of claim 28, the method further comprising at least one of:

providing a free-standing, collapsible garment stand having a collapsed position and a deployed position, in the deployed position the garment stand having at least one retention member positioned to releasably retain items above ground level when the garment stand is in the extended position;

providing a shower assembly positionable proximate to at least one of the collapsible shelter assemblies;

providing a hot water delivery system positionable proximate to at least one of the collapsible shelter assemblies;

providing a wash tub positionable proximate to at least one of the collapsible shelter assemblies;

providing a dispenser assembly for dispensing at least one of a powder and a liquid, the dispenser assembly being positionable proximate to at least one of the collapsible shelter assemblies;

providing a misting assembly positionable proximate to at least one of the collapsible shelter assemblies; and providing a fan positionable proximate to at least one of the collapsible shelter assemblies.

30. The method of claim 28, further comprising providing a weapons storage locker being adapted for retaining selected firearms and ammunition.

31. The method of claim 28, further comprising providing a shuffle box assembly positionable relative to at least one of the shelter assemblies, and further comprising the shuffle box assembly forming a shallow box structure with an open top side that personnel can step into, wherein the shuffle box assembly is further sized to retain therein one of a selected decontaminating material and a neutralizing material.

* * * * *